US010407640B2

(12) United States Patent
Boons

(10) Patent No.: US 10,407,640 B2
(45) Date of Patent: Sep. 10, 2019

(54) MARINE DIESEL CYLINDER LUBRICANT OIL COMPOSITIONS

(71) Applicant: Chevron Oronite Technology B.V., Rotterdam (NL)

(72) Inventor: Cornelis Hendrikus Maria Boons, Prinsenbeek (NL)

(73) Assignee: Chevron Oronite Technology B.V., Rotterdam (NL)

( * ) Notice: Subject to any disclaimer, the term of this patent is extended or adjusted under 35 U.S.C. 154(b) by 0 days.

(21) Appl. No.: 15/216,790

(22) Filed: Jul. 22, 2016

(65) Prior Publication Data

US 2017/0022442 A1 Jan. 26, 2017

Related U.S. Application Data

(60) Provisional application No. 62/195,472, filed on Jul. 22, 2015.

(51) Int. Cl.
*C10M 159/12* (2006.01)
*C10M 169/04* (2006.01)

(52) U.S. Cl.
CPC ..... *C10M 159/12* (2013.01); *C10M 169/04* (2013.01); *C10M 2203/10* (2013.01); *C10M 2203/1006* (2013.01); *C10M 2203/1025* (2013.01); *C10M 2207/262* (2013.01); *C10M 2215/064* (2013.01); *C10M 2215/28* (2013.01); *C10M 2219/044* (2013.01); *C10M 2219/046* (2013.01); *C10M 2219/089* (2013.01); *C10M 2223/045* (2013.01); *C10N 2220/021* (2013.01); *C10N 2230/04* (2013.01); *C10N 2230/10* (2013.01); *C10N 2230/18* (2013.01); *C10N 2230/52* (2013.01); *C10N 2240/102* (2013.01)

(58) Field of Classification Search
None
See application file for complete search history.

(56) References Cited

U.S. PATENT DOCUMENTS

| | | | |
|---|---|---|---|
| 2,992,708 | A | 7/1961 | Lyon et al. |
| 3,018,250 | A | 1/1962 | Anderson et al. |
| 3,018,291 | A | 1/1962 | Anderson et al. |
| 3,024,237 | A | 3/1962 | Drummond et al. |
| 3,100,673 | A | 8/1963 | Ulmer et al. |
| 3,172,892 | A | 3/1965 | Le Suer et al. |
| 3,215,707 | A | 11/1965 | Rense et al. |
| 3,219,666 | A | 11/1965 | Norman et al. |
| 3,231,587 | A | 1/1966 | Rense et al. |
| 3,272,746 | A | 9/1966 | Le Suer et al. |
| 3,515,669 | A | 6/1970 | Le Suer |
| 3,579,450 | A | 5/1971 | Le Suer et al. |
| 3,912,764 | A | 10/1975 | Palmer, Jr. |
| 4,115,206 | A | 9/1978 | Murtha |
| 4,384,115 | A | 5/1983 | Renga |
| 4,388,471 | A | 6/1983 | Wollenberg |
| 4,423,205 | A | 12/1983 | Rajan |
| 4,450,281 | A | 5/1984 | Wollenberg |
| 4,948,522 | A | 8/1990 | Dunn et al. |
| 5,059,299 | A | 10/1991 | Cody et al. |
| 5,733,839 | A | 3/1998 | Espinoza et al. |
| 6,103,672 | A | 8/2000 | Dunn et al. |
| 7,018,525 | B2 | 3/2006 | Miller et al. |
| 7,083,713 | B2 | 8/2006 | Abernathy et al. |
| 2004/0159582 | A1 | 8/2004 | Simmons et al. |
| 2005/0077208 | A1 | 4/2005 | Miller et al. |
| 2005/0133407 | A1 | 6/2005 | Abernathy et al. |
| 2005/0133409 | A1 | 6/2005 | Abenathy et al. |
| 2005/0139513 | A1 | 6/2005 | Miller |
| 2005/0139514 | A1 | 6/2005 | Miller |
| 2005/0153847 | A1 | 7/2005 | Chambard et al. |
| 2005/0209110 | A1* | 9/2005 | Roski ..... C10M 159/20 508/192 |
| 2005/0227866 | A1 | 10/2005 | Berge et al. |
| 2005/0241990 | A1 | 11/2005 | Ziermer et al. |
| 2005/0261145 | A1 | 11/2005 | Rosenbaum et al. |
| 2005/0261146 | A1 | 11/2005 | Rosenbaum et al. |
| 2005/0261147 | A1 | 11/2005 | Rosenbaum et al. |
| 2006/0013210 | A1 | 1/2006 | Bordogna et al. |
| 2006/0016721 | A1 | 1/2006 | Miller et al. |
| 2006/0016724 | A1 | 1/2006 | Miller et al. |
| 2006/0076267 | A1 | 4/2006 | Miller |
| 2006/0116298 | A1* | 6/2006 | Chambard ..... C10M 163/00 508/287 |

(Continued)

FOREIGN PATENT DOCUMENTS

| | | |
|---|---|---|
| EP | 668342 | 8/1995 |
| EP | 776959 | 11/1996 |
| EP | 1935970 | 6/2008 |
| EP | 2071009 | 6/2009 |

(Continued)

OTHER PUBLICATIONS

Hart's Lubricant World, Sep. 1997, pp. 27-28.

(Continued)

*Primary Examiner* — Vishal V Vasisth
(74) *Attorney, Agent, or Firm* — Ryan, Mason & Lewis, LLP

(57) ABSTRACT

Disclosed herein are marine diesel cylinder lubricating oil compositions which comprises (a) a major amount of an oil of lubricating viscosity, and (b) one or more non-borated polyalkenyl bis-succinimide dispersants, wherein the polyalkenyl substituent is derived from a polyalkene group having a number average molecular weight of from about 1500 to about 3000; and further wherein the marine diesel cylinder lubricating oil composition has a total base number (TBN) of about 5 to about 150. Also disclosed herein are marine diesel cylinder lubricating oil compositions which comprises (a) a major amount of an oil of lubricating viscosity, and (b) one or cyclic carbonate post-treated polyalkenyl bis-succinimide dispersants, wherein the marine diesel cylinder lubricating oil composition has a total base number (TBN) of about 5 to about 150.

20 Claims, No Drawings

(56) References Cited

U.S. PATENT DOCUMENTS

| | | | | |
|---|---|---|---|---|
| 2006/0201851 | A1 | 9/2006 | Rosenbaum et al. | |
| 2006/0270566 | A1* | 11/2006 | Chambard | C10M 159/20 508/192 |
| 2006/0289337 | A1 | 12/2006 | Rosenbaum et al. | |
| 2007/0142241 | A1* | 6/2007 | Nagamatsu | C10M 163/00 508/192 |
| 2009/0156440 | A1* | 6/2009 | Verlinde | C10M 133/56 508/229 |
| 2009/0281009 | A1* | 11/2009 | Van Houten | C10M 129/54 508/287 |
| 2015/0126422 | A1 | 5/2015 | Boons | |
| 2015/0126421 | A1 | 6/2015 | Boons | |

FOREIGN PATENT DOCUMENTS

| | | |
|---|---|---|
| WO | 199920720 | 4/1999 |
| WO | 199934917 | 7/1999 |
| WO | 2005107935 | 11/2005 |
| WO | 2011051261 | 5/2011 |
| WO | 2012138733 | 10/2012 |

OTHER PUBLICATIONS

API Publication 1509, 16th Edition, Addendum I, Oct. 2009.
Kirk-Othmer's "Encyclopedia of Chemical Technology", 2nd Ed., especially vol. 2, pp. 99-116, 1963.

* cited by examiner

MARINE DIESEL CYLINDER LUBRICANT OIL COMPOSITIONS

This application claims benefit of 62/195,472 filed Jul. 22, 2015.

BACKGROUND OF THE INVENTION

1. Technical Field

The present invention generally relates to a marine diesel cylinder lubricating oil composition, in particular, for lubricating a marine two-stroke crosshead diesel cylinder engine.

2. Description of the Related Art

In the not so distant past, rapidly escalating energy costs, particularly those incurred in distilling crude oil and liquid petroleum, became burdensome to the users of transportation fuels, such as owners and operators of seagoing ships. In response, those users have steered their operations away from steam turbine propulsion units in favor of large marine diesel engines that are more fuel efficient. Diesel engines may generally be classified as low-speed, medium-speed, or high-speed engines, with the low-speed variety being used for the largest, deep shaft marine vessels and certain other industrial applications.

Low-speed diesel engines are unique in size and method of operation. The engines themselves are massive, the larger units may approach 200 tons in weight and an upward of 10 feet in length and 45 feet in height. The output of these engines can reach as high as 100,000 brake horsepower with engine revolutions of 60 to about 200 revolutions per minute. They are typically of crosshead design and operate on the two-stroke cycle. These engines typically operate on residual fuels, but some may also operate on distillate fuels that contain little or no residue.

Medium-speed engines, on the other hand, typically operate in the range of about 250 to about 1100 rpm and may operate on either the four-stroke or the two-stroke cycle. These engines can be of trunk piston design or occasionally of crosshead design. They typically operate on residual fuels, just like the low-speed diesel engines, but some may also operate on distillate fuels that contain little or no residue. In addition, these engines can also be used for propulsion, ancillary applications or both on deep-sea vessels.

Low- and medium-speed diesel engines are also extensively used in power plant operations. A low- or medium-speed diesel engine that operates on the two-stroke cycle is typically a direct-coupled and direct-reversing engine of crosshead construction, with a diaphragm and one or more stuffing boxes separating the power cylinders from the crankcase to prevent combustion products from entering the crankcase and mixing with the crankcase oil. The notable complete separation of the crankcase from the combustion zone has led persons skilled in the art to lubricate the combustion chamber and the crankcase with different lubricating oils.

In large diesel engines of the crosshead type used in marine and heavy stationary applications, the cylinders are lubricated separately from the other engine components. The cylinders are lubricated on a total loss basis with the cylinder oil being injected separately to quills on each cylinder by means of lubricators positioned around the cylinder liner. Oil is distributed to the lubricators by means of pumps, which are, in modern engine designs, actuated to apply the oil directly onto the rings to reduce wastage of the oil.

One problem associated with these engines is that their manufacturers commonly design them to use a variety of diesel fuels, ranging from good quality high distillate fuel with low sulfur and low asphaltene content to poorer quality intermediate or heavy fuel such as marine residual fuel with generally high sulfur and higher asphaltene content.

The high stresses encountered in these engines and the use of marine residual fuels creates the need for lubricants with high detergency, neutralizing capability and better stability against oxidation based viscosity increase even though the oils are exposed to thermal and other stresses only for short periods of time. Residual fuels commonly used in these diesel engines typically contain significant quantities of sulfur, which, in the combustion process, combine with water to form sulfuric acid, the presence of which leads to corrosive wear. In particular, in two-stroke engines for ships, areas around the cylinder liners and piston rings can be corroded and worn by the acid. Therefore, it is important for diesel engine lubricating oils to have the ability to resist such corrosion and wear.

Accordingly, one of the primary functions of a marine diesel cylinder lubricant is to neutralize sulfur-based acidic components of high-sulfur fuel oil combusted in low-speed 2-stroke crosshead diesel engines. This neutralization is accomplished by the inclusion in the marine diesel cylinder lubricant of basic species such as metallic detergents. Unfortunately the basicity of the marine diesel cylinder lubricant can be diminished by oxidation of the marine diesel cylinder lubricant (caused by the thermal and oxidative stress the lubricant undergoes in the engine), thus decreasing the lubricant's neutralization ability. Oxidation stability is therefore one of the key performance aspects of a marine cylinder lubricant. Oxidation can be accelerated if the marine diesel cylinder lubricant contains oxidation catalysts such as wear metals that are generally known to be present in the lubricant during engine operation.

Typically, marine cylinder lubricants for use in marine diesel engines have a viscosity in the range of 9.3 to 26.1 centistokes (cSt) at 100° C. In order to formulate such a lubricant, a brightstock can be combined with a low viscosity oil, e.g., an oil having a viscosity from 4 to 6 cSt at 100° C. However, supplies of brightstock are dwindling and therefore brightstock cannot be relied upon to increase the viscosity of marine cylinder lubricants to the range of 16.5 to 25 cSt at 100° C. that manufacturers recommend. In addition, Hart's Lubricant World, September 1997, pp. 27-28, (referenced in EP 1967571) discloses that "Due to low-operating speeds and high loads in marine engines, high viscosity oils (SAE 40, 50, and 60) typically are required. Because hydrocracking results in a viscosity loss of the base stocks, marine oils cannot generally be formulated solely with hydrocracked base stocks, but require the use of significant amounts of brightstock. However, the use of brightstock is not desirable because of the presence of oxidatively unstable aromatics."

One solution to this problem is to use thickeners such as polyisobutylene or viscosity index improver compounds such as olefin copolymers to thicken the marine cylinder lubricants. However, these materials add to the cost of the marine cylinder lubricants. Another solution is to use lower viscosity marine cylinder lubricants; but the wear performance of low viscosity MCLs has not been well investigated.

Another important performance aspect of a marine cylinder lubricant is foaming performance. Foam forms when a large amount of gas is entrained in a liquid. While foaming is desirable in certain applications, such as floatation, washing and cleaning, it can be undesirable in lubricant-related applications where foaming can be an impediment because it leads to ineffective lubrication. The viscosity and surface tension of a lubricant contribute to the stability of the foam. Low-viscosity oils produce foams with large bubbles, which tend to break quickly and be minimally problematic. However, high-viscosity oils, such as those used as marine cylinder lubricants, generate stable foams that contain fine bubbles and are difficult to break. For marine cylinder lubricants, foaming may lead to disturbances in the lubricant film that keeps the piston ring and cylinder liner surfaces separated. Over time, foaming may also accelerate oxidative degradation of the lubricant and in addition may have effects on the transporting and pumping ability of the oil. Therefore, for marine cylinder lubricants, a foaming specification is often in place for the manufactured product.

U.S. Pat. No. 6,103,672 ("the '672 patent") discloses a polybutene free marine cylinder lubricant containing a major amount of oil of lubricating viscosity and, provided by admixing therewith, minor amounts of a) at least one of a borated dispersant or oil-soluble or oil-dispersible boron compound; and b) one or more overbased metal compounds. The '672 patent further discloses that the polybutene free marine cylinder lubricant demonstrated improved viscometric properties.

U.S. Pat. No. 4,948,522 ("the '522 patent") discloses a marine diesel cylinder lubricant containing a borated ashless dispersant, an overbased metal compound and a polybutene having a weight average molecular weight of greater than 100,000. The '522 patent further discloses that the marine diesel cylinder lubricant provides which exhibit increased oxidation, wear and deposits.

U.S. Patent Application Publication 2005/0153847 discloses a marine diesel cylinder lubricant composition having a total base number of at least 30 and comprising: (a) at least 40 mass percent of an oil of lubricating viscosity, (b) a detergent prepared from at least two surfactants, (c) a boron-containing dispersant, and (d) a zinc-containing antiwear additive.

WO 2011051261 discloses Teaches lubricating compositions used in internal combustion engines operated under sustained high load conditions, such as marine diesel engines and power applications, comprising base oil and a combination of a sulphonate and phenate detergent. The examples disclosed in WO 2011051261 employ a high molecular weight polyisobutene succinimide at a concentration of 1.5 wt. % of the composition.

A need still remains, therefore, for an improved marine diesel cylinder lubricating oil composition having oxidative stability as well as foam control, which further allows for a reduction in the amount of brightstock that is used in the lubricating oil composition.

SUMMARY OF THE INVENTION

In accordance with one embodiment of the present invention, there is provided a marine diesel cylinder lubricating oil composition which comprises (a) a major amount of an oil of lubricating viscosity, and (b) one or more non-borated polyalkenyl bis-succinimide dispersants, wherein the polyalkenyl substituent is derived from a polyalkene group having a number average molecular weight of from about 1500 to about 3000; and further wherein the marine diesel cylinder lubricating oil composition has a total base number (TBN) of about 5 to about 150.

In accordance with a second embodiment of the present invention, there is provided a method for lubricating a marine two-stroke crosshead diesel engine with a marine diesel cylinder lubricant composition having improved oxidation stability; wherein the method comprises operating the engine with a marine diesel cylinder lubricating oil composition comprising (a) a major amount of an oil of lubricating viscosity, and (b) one or more non-borated polyalkenyl bis-succinimide dispersants, wherein the polyalkenyl substituent is derived from a polyalkene group having a number average molecular weight of from about 1500 to about 3000; and further wherein the marine diesel cylinder lubricating oil composition has a total base number (TBN) of about 5 to about 150.

In accordance with a third embodiment of the present invention, there is provided the use of one or more non-borated polyalkenyl bis-succinimide dispersants, wherein the polyalkenyl substituent is derived from a polyalkene group having a number average molecular weight of from about 1500 to about 3000 in a marine diesel cylinder lubricating oil composition comprising (a) a major amount of an oil of lubricating viscosity, wherein the marine diesel cylinder lubricating oil composition has a total base number (TBN) of about 5 to about 150, to provide a marine diesel cylinder lubricating oil composition having improved oxidation stability in a two-stroke crosshead marine diesel engine.

In accordance with a fourth embodiment of the present invention, there is provided a marine diesel cylinder lubricating oil composition which comprises (a) a major amount of an oil of lubricating viscosity, and (b) one or more cyclic carbonate post-treated polyalkenyl bis-succinimide dispersants; and wherein the marine diesel cylinder lubricating oil composition has a total base number (TBN) of about 5 to about 150.

In accordance with a fifth embodiment of the present invention, there is provided a method for lubricating a marine two-stroke crosshead diesel engine with a marine diesel cylinder lubricant composition having improved oxidation stability; wherein the method comprises operating the engine with a marine diesel cylinder lubricating oil composition comprising (a) a major amount of an oil of lubricating viscosity, and (b) one or more cyclic carbonate post-treated polyalkenyl bis-succinimide dispersants; and wherein the marine diesel cylinder lubricating oil composition has a total base number (TBN) of about 5 to about 150.

In accordance with a sixth embodiment of the present invention, there is provided the use of one or more cyclic carbonate post-treated polyalkenyl bis-succinimide dispersants in a marine diesel cylinder lubricating oil composition comprising (a) a major amount of an oil of lubricating viscosity, wherein the marine diesel cylinder lubricating oil composition has a total base number (TBN) of about 5 to about 150, to provide a marine diesel cylinder lubricating oil composition having improved oxidation stability in a two-stroke crosshead marine diesel engine.

The present invention is based on the surprising discovery that either a non-borated polyalkenyl bis-succinimide dispersant wherein the polyalkenyl substituent is derived from a polyalkene group having a number average molecular weight of from about 1500 to about 3000 or a cyclic carbonate post-treated polyalkenyl bis-succinimide dispersant advantageously improves the oxidation stability of a marine diesel cylinder lubricating oil composition used in a two-stroke crosshead marine diesel engine; wherein the marine diesel cylinder lubricant has a TBN of from about 5 to about 150. In addition, the non-borated polyalkenyl bis-succinimide dispersant wherein the polyalkenyl substituent is derived from a polyalkene group having a number average molecular weight of from about 1500 to about 3000 or a cyclic carbonate post-treated polyalkenyl bis-succinimide dispersant also advantageously controls foaming of a marine diesel cylinder lubricating oil composition having a TBN of from about 5 to about 150. Further, the use of the non-borated polyalkenyl bis-succinimide dispersant wherein the polyalkenyl substituent is derived from a polyalkene group having a number average molecular weight of from about 1500 to about 3000 or a cyclic carbonate post-treated polyalkenyl bis-succinimide dispersant advantageously allows for lesser amounts of brightstock when formulating a marine diesel cylinder lubricating oil composition having a TBN of from about 5 to about 150.

DETAILED DESCRIPTION OF THE PREFERRED EMBODIMENTS

Definitions

The term "marine diesel cylinder lubricant" or "marine diesel cylinder lubricating oil" as used herein shall be understood to mean a lubricant used in the cylinder lubrication of a low speed or medium speed two-stroke crosshead marine diesel engine. The marine diesel cylinder lubricant is fed to the cylinder walls through a number of injection points. Marine diesel cylinder lubricants are capable of providing a film between the cylinder liner and the piston rings and holding partially burned fuel residues in suspension, to thereby promote engine cleanliness and neutralize acids formed by, for example, the combustion of sulfur compounds in the fuel.

A "marine residual fuel" refers to a material combustible in large marine engines which has a carbon residue, as defined in International Organization for Standardization (ISO) 10370) of at least 2.5 wt. % (e.g., at least 5 wt. %, or at least 8 wt. %) (relative to the total weight of the fuel), a viscosity at 50° C. of greater than 14.0 cSt, such as the marine residual fuels defined in the International Organization for Standardization specification ISO 8217:2005, "Petroleum products—Fuels (class F)—Specifications of marine fuels," the contents of which are incorporated herein in their entirety.

A "residual fuel" refers to a fuel meeting the specification of a residual marine fuel as set forth in the ISO 8217:2010 international standard. A "low sulfur marine fuel" refers to a fuel meeting the specification of a residual marine fuel as set forth in the ISO 8217:2010 specification that, in addition, has about 1.5 wt. % or less, or even about 0.5% wt. % or less, of sulfur, relative to the total weight of the fuel.

A "distillate fuel" refers to a fuel meeting the specification of a distillate marine fuel as set forth in the ISO 8217:2010 international standard. A "low sulfur distillate fuel" refers to a fuel meeting the specification of a distillate marine fuel set forth in the ISO 8217:2010 international standard that, in addition, has about 0.1 wt. % or less or even about 0.005 wt. % or less, of sulfur, relative to the total weight of the fuel.

The term "brightstock", as used by persons skilled in the art, refers to base oils that are direct products of de-asphalted petroleum vacuum residuum or derived from de-asphalted petroleum vacuum residuum after further processing such as solvent extraction and/or dewaxing. For the purposes of this invention, it also refers to deasphalted distillate cuts of a vacuum residuum process. Brightstocks generally have a kinematic viscosity at 100° C. of from 28 to 36 $mm^2/s$. One example of such a brightstock is ESSO™ Core 2500 Base Oil.

The term "succinimide" which includes alkenyl or alkyl mono-, bis-succinimides and other higher analogs, has been generally accepted as meaning the product of a reaction of an alkenyl substituted succinic acid or anhydride with a polyamine.

The term "bis-succinimide" describes a succinimide dispersant which is predominantly bis-succinimide. A predominantly bis-succinimide dispersant contains a major amount of bis-succinimide relative to other compounds, such as mono-succinimide, that may be present in the succinimide dispersant. The reaction product of hydrocarbyl-substituted succinic acylating agent with alkylene polyamine will result in a succinimide dispersant comprising a mixture of compounds including mono-succinimides and bis-succinimides. The amount of mono alkenyl succinimide and bis alkenyl succinimide produced may depend on the charge mole ratio of alkylene polyamine to succinic groups and the particular polyamine used. Charge mole ratios of alkylene polyamine to succinic groups of about 1:1 may produce a predominantly mono-succinimide dispersant. Charge mole ratios of alkylene polyamine to succinic groups of about 1:2 may produce a predominantly bis-succinimide dispersant.

The term "Group II metal" or "alkaline earth metal" means calcium, barium, magnesium, and strontium.

The term "calcium base" refers to a calcium hydroxide, calcium oxide, calcium alkoxide and the like and mixtures thereof.

The term "lime" refers to calcium hydroxide also known as slaked lime or hydrated lime.

The term "alkylphenol" refers to a phenol group having one or more alkyl substituents at least one of which has a sufficient number of carbon atoms to impart oil solubility to the resulting phenate additive.

The term "Total Base Number" or "TBN" refers to the level of alkalinity in an oil sample, which indicates the ability of the composition to continue to neutralize corrosive acids, in accordance with ASTM Standard No. D2896 or equivalent procedure. The test measures the change in electrical conductivity, and the results are expressed as mg·KOH/g (the equivalent number of milligrams of KOH needed to neutralize 1 gram of a product). Therefore, a high TBN reflects strongly overbased products and, as a result, a higher base reserve for neutralizing acids.

The term "base oil" as used herein shall be understood to mean a base stock or blend of base stocks which is a lubricant component that is produced by a single manufacturer to the same specifications (independent of feed source or manufacturer's location); that meets the same manufacturer's specification; and that is identified by a unique formula, product identification number, or both.

The term "on an actives basis" refers to additive material that is not diluent oil or solvent.

In one embodiment, a marine diesel cylinder lubricating oil composition is provided which comprises (a) a major amount of an oil of lubricating viscosity, and (b) a non-borated polyalkenyl bis-succinimide dispersant wherein the polyalkenyl substituent is derived from a polyalkene group having a number average molecular weight of from about 1500 to about 3000; and wherein the marine diesel cylinder lubricating oil composition has a total base number (TBN) of about 5 to about 150.

The marine diesel cylinder lubricating oil composition of the present invention can have any TBN that is suitable for use as a marine cylinder lubricant. In some embodiments, the TBN of the marine diesel cylinder lubricating oil composition of the present invention is less than about 150 mg·KOH/g. In other embodiments, the TBN of the marine diesel cylinder lubricating oil composition of the present invention can range from about 5 to about 150, or from about 5 to about 100, or from about 5 to about 70, or from about 5 to about 30, or from about 5 to about 25, or from about 10 to about 150, or from about 10 to about 70, or from about 10 to about 40, or from about 10 to about 30, or from about 15 to about 150, or from about 15 to about 100, or from about 15 to about 70, or from about 15 to about 30, or from about 15 to about 40, or from about 20 to about 150, or from about 20 to about 100, or from about 20 to about 70, or from about 20 to about 40, or from about 20 to about 30, mg KOH/g.

Due to low-operating speeds and high loads in marine engines, high viscosity oils (SAE 40, 50, and 60) are typically required. The marine diesel cylinder lubricating oil compositions of this invention can have a kinematic viscosity ranging from about 12.5 to about 26.1 cSt, or about 12.5 to about 21.9, or about 16.3 to about 21.9 cSt at 100° C. The kinematic viscosity of the marine diesel cylinder lubricating oil compositions is measured by ASTM D445.

The marine diesel cylinder lubricating oil compositions of the present invention can be prepared by any method known to a person of ordinary skill in the art for making marine diesel cylinder lubricating oil compositions. The ingredients can be added in any order and in any manner. Any suitable mixing or dispersing equipment may be used for blending, mixing or solubilizing the ingredients. The blending, mixing or solubilizing may be carried out with a blender, an agitator, a disperser, a mixer (e.g., planetary mixers and double planetary mixers), a homogenizer (e.g., a Gaulin homogenizer or Rannie homogenizer), a mill (e.g., colloid mill, ball mill or sand mill) or any other mixing or dispersing equipment known in the art.

The marine diesel cylinder lubricant composition of the present invention includes a major amount of an oil of lubricating viscosity. By "a major amount" it is meant that the marine diesel cylinder lubricant composition suitably includes at least about 40 wt. %, or at least about 50 wt. %, or at least about 60 wt. %, and particularly at least about 70 wt. %, of an oil of lubricating viscosity as described below, based on the total weight of the marine diesel cylinder lubricant oil composition. In one embodiment, the oil of lubricating viscosity is present in an amount of from 70 wt. % to about 95 wt. %, based on the total weight of the marine diesel cylinder lubricant composition. In one embodiment, the oil of lubricating viscosity is present in an amount of from 70 wt. % to about 85 wt. %, based on the total weight of the marine diesel cylinder lubricant composition.

The oil of lubricating viscosity may be any oil suitable for the lubrication of large diesel engines including, for example, cross-head engines. The oil of lubricating viscosity may be a base oil derived from natural lubricating oils, synthetic lubricating oils or mixtures thereof. Suitable base oil includes base stocks obtained by isomerization of synthetic wax and slack wax, as well as hydrocracked base stocks produced by hydrocracking (rather than solvent extracting) the aromatic and polar components of the crude.

Suitable natural oils include mineral lubricating oils such as, for example, liquid petroleum oils, solvent-treated or acid-treated mineral lubricating oils of the paraffinic, naphthenic or mixed paraffinic-naphthenic types, oils derived from coal or shale, animal oils, vegetable oils (e.g., rapeseed oils, castor oils and lard oil), and the like.

Suitable synthetic lubricating oils include, but are not limited to, hydrocarbon oils and halo-substituted hydrocarbon oils such as polymerized and interpolymerized olefins, e.g., polybutylenes, polypropylenes, propylene-isobutylene copolymers, chlorinated polybutylenes, poly(1-hexenes), poly(1-octenes), poly(1-decenes), and the like and mixtures thereof alkylbenzenes such as dodecylbenzenes, tetradecylbenzenes, dinonylbenzenes, di(2-ethylhexyl)-benzenes, and the like; polyphenyls such as biphenyls, terphenyls, alkylated polyphenyls, and the like; alkylated diphenyl ethers and alkylated diphenyl sulfides and the derivative, analogs and homologs thereof and the like.

Other synthetic lubricating oils include, but are not limited to, oils made by polymerizing olefins of less than 5 carbon atoms such as ethylene, propylene, butylenes, isobutene, pentene, and mixtures thereof. Methods of preparing such polymer oils are well known to those skilled in the art.

Additional synthetic hydrocarbon oils include liquid polymers of alpha olefins having the proper viscosity. Especially useful synthetic hydrocarbon oils are the hydrogenated liquid oligomers of $C_6$ to $C_{12}$ alpha olefins such as, for example, 1-decene trimer.

Another class of synthetic lubricating oils include, but are not limited to, alkylene oxide polymers, i.e., homopolymers, interpolymers, and derivatives thereof where the terminal hydroxyl groups have been modified by, for example, esterification or etherification. These oils are exemplified by the oils prepared through polymerization of ethylene oxide or propylene oxide, the alkyl and phenyl ethers of these polyoxyalkylene polymers (e.g., methyl poly propylene glycol ether having an average molecular weight of 1,000, diphenyl ether of polyethylene glycol having a molecular weight of 500-1000, diethyl ether of polypropylene glycol having a molecular weight of 1,000-1,500, etc.) or mono- and polycarboxylic esters thereof such as, for example, the acetic esters, mixed $C_3$-$C_8$ fatty acid esters, or the $C_{13}$ oxo acid diester of tetraethylene glycol.

Yet another class of synthetic lubricating oils include, but are not limited to, the esters of dicarboxylic acids e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acids, alkyl malonic acids, alkenyl malonic acids, etc., with a variety of alcohols, e.g., butyl alcohol, hexyl alcohol, dodecyl alcohol, 2-ethylhexyl alcohol, ethylene glycol, diethylene glycol monoether, propylene glycol, etc. Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include, but are not limited to, those made from carboxylic acids having from about 5 to about 12 carbon atoms with alcohols, e.g., methanol, ethanol, etc., polyols and polyol ethers such as neopentyl glycol, trimethylol propane, pentaerythritol, dipentaerythritol, tripentaerythritol, and the like.

Silicon-based oils such as, for example, polyalkyl-, polyaryl-, polyalkoxy- or polyaryloxy-siloxane oils and silicate oils, comprise another useful class of synthetic lubricating oils. Specific examples of these include, but are not limited to, tetraethyl silicate, tetra-isopropyl silicate, tetra-(2-ethylhexyl) silicate, tetra-(4-methyl-hexyl)silicate, tetra-(p-tert-butylphenyl)silicate, hexyl-(4-methyl-2-pentoxy)disiloxane, poly(methyl)siloxanes, poly(methylphenyl)siloxanes, and the like. Still yet other useful synthetic lubricating oils include, but are not limited to, liquid esters of phosphorous containing acids, e.g., tricresyl phosphate, trioctyl phosphate, diethyl ester of decane phosphionic acid, etc., polymeric tetrahydrofurans and the like.

The oil of lubricating viscosity may be derived from unrefined, refined and rerefined oils, either natural, synthetic or mixtures of two or more of any of these of the type disclosed hereinabove. Unrefined oils are those obtained directly from a natural or synthetic source (e.g., coal, shale, or tar sands bitumen) without further purification or treatment. Examples of unrefined oils include, but are not limited to, a shale oil obtained directly from retorting operations, a petroleum oil obtained directly from distillation or an ester oil obtained directly from an esterification process, each of which is then used without further treatment. Refined oils are similar to the unrefined oils except they have been further treated in one or more purification steps to improve one or more properties. These purification techniques are known to those of skill in the art and include, for example, solvent extractions, secondary distillation, acid or base extraction, filtration, percolation, hydrotreating, dewaxing, etc. Rerefined oils are obtained by treating used oils in processes similar to those used to obtain refined oils. Such rerefined oils are also known as reclaimed or reprocessed oils and often are additionally processed by techniques directed to removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst.

Natural waxes are typically the slack waxes recovered by the solvent dewaxing of mineral oils; synthetic waxes are typically the wax produced by the Fischer-Tropsch process.

In one embodiment, the oil of lubricating viscosity is a Group I basestock. In general, a Group I basestock for use herein can be any petroleum derived base oil of lubricating viscosity as defined in API Publication 1509, $16^{th}$ Edition, Addendum I, October, 2009. API guidelines define a base stock as a lubricant component that may be manufactured using a variety of different processes. Group I base oils generally refer to a petroleum derived lubricating base oil having a saturates content of less than 90 wt. % (as determined by ASTM D 2007) and/or a total sulfur content of greater than 300 ppm (as determined by ASTM D 2622, ASTM D 4294, ASTM D 4297 or ASTM D 3120) and has a viscosity index (VI) of greater than or equal to 80 and less than 120 (as determined by ASTM D 2270).

Group I base oils can comprise light overhead cuts and heavier side cuts from a vacuum distillation column and can also include, for example, Light Neutral, Medium Neutral, and Heavy Neutral base stocks. The petroleum derived base oil also may include residual stocks or bottoms fractions, such as, for example, brightstock. Brightstock is a high viscosity base oil which has been conventionally produced from residual stocks or bottoms and has been highly refined and dewaxed. Brightstock can have a kinematic viscosity greater than about 180 cSt at 40° C., or even greater than about 250 cSt at 40° C., or even ranging from about 500 to about 1100 cSt at 40° C.

In one embodiment, the one or more basestocks can be a blend or mixture of two or more, three or more, or even four or more Group I basestocks having different molecular weights and viscosities, wherein the blend is processed in any suitable manner to create a base oil having suitable properties (such as the viscosity and TBN values, discussed above) for use in a marine diesel engine. In one embodiment, the one or more basestocks comprises ExxonMobil CORE®100, ExxonMobil CORE®150, ExxonMobil CORE®600, ExxonMobil CORE®2500, or a combination or mixture thereof.

In another embodiment, the oil of lubricating viscosity is a Group II basestock as defined in API Publication 1509, $16^{th}$ Edition, Addendum I, October, 2009. A Group II basestock generally refer to a petroleum derived lubricating base oil having a total sulfur content equal to or less than 300 parts per million (ppm) (as determined by ASTM D 2622, ASTM D 4294, ASTM D 4927 or ASTM D 3120), a saturates content equal to or greater than 90 weight percent (as determined by ASTM D 2007), and a viscosity index (VI) of between 80 and 120 (as determined by ASTM D 2270).

In another embodiment, the oil of lubricating viscosity is a Group III basestock as defined in API Publication 1509, $16^{th}$ Edition, Addendum I, October, 2009. A Group III basestock generally has a total sulfur content less than or equal to 0.03 wt. % (as determined by ASTM D 2270), a saturates content of greater than or equal to 90 wt. % (as determined by ASTM D 2007), and a viscosity index (VI) of greater than or equal to 120 (as determined by ASTM D 4294, ASTM D 4297 or ASTM D 3120). In one embodiment, the basestock is a Group III basestock, or a blend of two or more different Group III basestocks.

In general, Group III basestocks derived from petroleum oils are severely hydrotreated mineral oils. Hydrotreating involves reacting hydrogen with the basestock to be treated to remove heteroatoms from the hydrocarbon, reduce olefins and aromatics to alkanes and cycloparaffins respectively, and in very severe hydrotreating, open up naphthenic ring structures to non-cyclic normal and iso-alkanes ("paraffins"). In one embodiment, a Group III basestock has a paraffinic carbon content (% $C_p$) of at least about 70%, as determined by test method ASTM D 3238-95 (2005), "Standard Test Method for Calculation of Carbon Distribution and Structural Group Analysis of Petroleum Oils by the n-d-M Method". In another embodiment, a Group III basestock has a paraffinic carbon content (% $C_p$) of at least about 72%. In another embodiment, a Group III basestock has a paraffinic carbon content (% $C_p$) of at least about 75%. In another embodiment, a Group III basestock has a paraffinic carbon content (% $C_p$) of at least about 78%. In another embodiment, a Group III basestock has a paraffinic carbon content (% $C_p$) of at least about 80%. In another embodiment, a Group III basestock has a paraffinic carbon content (% $C_p$) of at least about 85%.

In another embodiment, a Group III basestock has a naphthenic carbon content (% $C_n$) of no more than about 25%, as determined by ASTM D 3238-95 (2005). In another embodiment, a Group III basestock has a naphthenic carbon content (% $C_n$) of no more than about 20%. In another embodiment, a Group III basestock has a naphthenic carbon content (% $C_n$) of no more than about 15%. In another embodiment, a Group III basestock has a naphthenic carbon content (% $C_n$) of no more than about 10%.

Many of the Group III basestocks are available commercially, e.g., Chevron UCBO basestocks; Yukong Yubase basestocks; Shell XHVI® basestocks; and ExxonMobil Exxsyn® basestocks.

In one embodiment, a Group III basestock for use herein is a Fischer-Tropsch derived base oil. The term "Fischer-Tropsch derived" means that the product, fraction, or feed originates from or is produced at some stage by a Fischer-Tropsch process. For example, a Fischer Tropsch base oil can be produced from a process in which the feed is a waxy feed recovered from a Fischer-Tropsch synthesis, see, e.g., U.S. Patent Application Publication Nos. 2004/0159582; 2005/0077208; 2005/0133407; 2005/0133409; 2005/0139513; 2005/0139514; 2005/0241990; 2005/0261145; 2005/0261146; 2005/0261147; 2006/0016721; 2006/0016724; 2006/0076267; 2006/013210; 2006/0201851; 2006/020185, and 2006/0289337; U.S. Pat. Nos. 7,018,525 and 7,083,713 and U.S. application Ser. Nos. 11/400,570, 11/535,165 and Ser. No. 11/613,936, each of which are incorporated herein by reference. In general, the process involves a complete or partial hydroisomerization dewaxing step, employing a dual-functional catalyst or a catalyst that can isomerize paraffins selectively. Hydroisomerization dewaxing is achieved by contacting the waxy feed with a hydroisomerization catalyst in an isomerization zone under hydroisomerizing conditions.

Fischer-Tropsch synthesis products can be obtained by well-known processes such as, for example, the commercial SASOL® Slurry Phase Fischer-Tropsch technology, the commercial SHELL® Middle Distillate Synthesis (SMDS) Process, or by the non-commercial EXXON® Advanced Gas Conversion (AGC-21) process. Details of these processes and others are described in, for example, WO-A-9934917; WO-A-9920720; WO-A-05107935; EP-A-776959; EP-A-668342; U.S. Pat. Nos. 4,943,672, 5,059,299, 5,733,839, and RE39073; and U.S. Patent Application Publication No. 2005/0227866. The Fischer-Tropsch synthesis product can contain hydrocarbons having 1 to about 100 carbon atoms or, in some cases, more than 100 carbon atoms, and typically includes paraffins, olefins and oxygenated products.

In another embodiment, the oil of lubricating viscosity is a Group IV basestock as defined in API Publication 1509, $16^{th}$ Edition, Addendum I, October, 2009. A Group IV basestock, or polyalphaolefin (PAO) are typically made by the oligomerization of low molecular weight alpha-olefins, e.g., alpha-olefins containing at least 6 carbon atoms. In one embodiment, the alpha-olefins are alpha-olefins containing 10 carbon atoms. PAOs are mixtures of dimers, trimers, tetramers, etc., with the exact mixture depending upon the viscosity of the final basestock desired. PAOs are typically hydrogenated after oligomerization to remove any remaining unsaturation.

Group V base oils include all other base oils not included in Group I, II, III, or IV.

As stated above, the marine cylinder lubricants for use in marine diesel engines typically have a kinematic viscosity in the range of 9.3 to 26.1 cSt at 100° C. In order to formulate such a lubricant, a brightstock may be combined with a low viscosity oil, e.g., an oil having a viscosity from 4 to 6 cSt at 100° C. However, supplies of brightstock are dwindling and therefore brightstock cannot be relied upon to increase the viscosity of marine cylinder lubricants to the desired ranges that manufacturers recommend. One solution to this problem is to use thickeners such as polyisobutylene (PIB) or viscosity index improver compounds such as olefin copolymers to thicken marine cylinder lubricants. PIB is a commercially available material from several manufacturers. The PIB is typically a viscous oil-miscible liquid, having a weight average molecular weight in the range of about 1,000 to about 8,000, or from about 1,500 to about 6,000, and a viscosity in the range of about 2,000 to about 5,000 or about 6,000 cS (100° C.). The amount of PIB added to the marine cylinder lubricants will normally be from about 1 to about 20 wt. % of the finished oil, or from about 2 to about 15 wt. % of the finished oil, or from about 4 to about 12 wt. % of the finished oil.

In one embodiment, the marine diesel cylinder lubricating oil composition of the present invention further includes one or more non-borated polyalkenyl bis-succinimide dispersants wherein the polyalkenyl substituent is derived from a polyalkene group having a number average molecular weight of from about 1500 to about 3000. In general, a bis-succinimide is the completed reaction product from the reaction between a polyalkenyl-substituted succinic acid or anhydride and one or more polyamine reactants, and is intended to encompass compounds wherein the product may have amide, amidine, and/or salt linkages in addition to the imide linkage of the type that results from the reaction of a primary amino group and anhydride moiety. The bis-succinimide dispersants is prepared according to methods that are well known in the art, e.g., certain fundamental types of succinimides and related materials encompassed by the term of art "succinimide" are taught in, for example, U.S. Pat. Nos. 2,992,708; 3,018,291; 3,024,237; 3,100,673; 3,219,666; 3,172,892; and 3,272,746, the content of which are hereby incorporated by reference.

In one embodiment. the one or more non-borated polyalkenyl bis-succinimide dispersants can be obtained by reacting a polyalkenyl-substituted succinic anhydride of formula I:

(I)

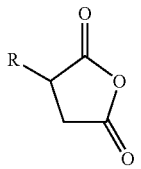

wherein R is a polyalkenyl substituent is derived from a polyalkene group having a number average molecular weight of from about 1500 to about 3000 with a polyamine. In one embodiment, R is a polyalkenyl substituent is derived from a polyalkene group having a number average molecular weight of from about 1500 to about 2500. In one embodiment, R is a polybutenyl substituent derived from a polybutene having a number average molecular weight of from about 1500 to about 3000. In another embodiment, R is a polybutenyl substituent derived from a polybutene having a number average molecular weight of from about 1500 to about 2500.

The polyalkenyl succinic anhydride of formula I is either commercially available from such sources as, for example, Sigma Aldrich Corporation (St. Louis, Mo., U.S.A.), or can be prepared by any method well known in the art. For example, the preparation of the polyalkenyl-substituted succinic anhydride by reaction with a polyolefin and maleic anhydride has been described in, e.g., U.S. Pat. Nos. 3,018,250 and 3,024,195. Such methods include the thermal reaction of the polyolefin with maleic anhydride and the reaction of a halogenated polyolefin, such as a chlorinated polyolefin, with maleic anhydride. Reduction of the polyalkenyl-substituted succinic anhydride yields the corresponding alkyl derivative. Alternatively, the polyalkenyl substituted succinic anhydride may be prepared as described in, e.g., U.S. Pat. Nos. 4,388,471 and 4,450,281, the contents of which are incorporated by reference herein.

The size of the polyalkenyl substituent is advantageously one that is derived from a polyalkene group having a number average molecular weight of about 1500 to about 3000. In one embodiment, the size of the polyalkenyl substituent is advantageously one that is derived from a polyalkene group having a number average molecular weight of about 1500 to 2500. In another embodiment, the size of the polyalkenyl substituent is advantageously one that is derived from a polyalkene group having a number average molecular weight of about 2300.

Polyalkene groups having a number average molecular weight of from about 1500 to about 3000 for reaction with a succinic anhydride such as maleic anhydride are polymers comprising a major amount of $C_2$ to $C_5$ mono-olefin, e.g., ethylene, propylene, butylene, isobutylene and pentene. The polymers can be homopolymers such as polyisobutylene as well as copolymers of 2 or more such olefins such as copolymers of: ethylene and propylene, butylene, and isobutylene, etc. Other copolymers include those in which a minor amount of the copolymer monomers, e.g., 1 to 20 mole percent is a $C_4$ to $C_8$ nonconjugated diolefin, e.g., a copolymer of isobutylene and butadiene or a copolymer of ethylene, propylene and 1,4-hexadiene, etc.

A particularly preferred class of polyalkene groups having a number average molecular weight of from about 1500 to about 3000 include polybutenes, which are prepared by polymerization of one or more of 1-butene, 2-butene and isobutene. Especially desirable are polybutenes containing a substantial proportion of units derived from isobutene. The polybutene may contain minor amounts of butadiene which may or may not be incorporated in the polymer. Most often the isobutene units constitute about 80%, or at least about 90%, of the units in the polymer. These polybutenes are readily available commercial materials well known to those skilled in the art, e.g., those described in, for example, U.S. Pat. Nos. 3,215,707; 3,231,587; 3,515,669; 3,579,450, and 3,912,764, the contents of which are incorporated by reference herein.

Suitable polyamines for use in preparing the non-borated bis-succinimide dispersants include polyalkylene polyamines. Such polyalkylene polyamines will typically contain about 2 to about 12 nitrogen atoms and about 2 to 24 carbon atoms. Particularly suitable polyalkylene polyamines are those having the formula: $H_2N—(R^1NH)_c—H$ wherein $R^1$ is a straight- or branched-chain alkylene group having 2 or 3 carbon atoms and c is 1 to 9. Representative examples of suitable polyalkylene polyamines include ethylenediamine, diethylenetriamine, triethylenetetraamine, tetraethylenepentamine and mixtures thereof. Most preferably, the polyalkylene polyamine is tetraethylenepentamine.

Many of the polyamines suitable for use in the present invention are commercially available and others may be prepared by methods which are well known in the art. For example, methods for preparing amines and their reactions are detailed in Sidgewick's "The Organic Chemistry of Nitrogen", Clarendon Press, Oxford, 1966; Noller's "Chemistry of Organic Compounds", Saunders, Philadelphia, 2nd Ed., 1957; and Kirk-Othmer's "Encyclopedia of Chemical Technology", 2nd Ed., especially Volume 2, pp. 99 116.

Examples of suitable polyamines include tetraethylene pentamine, pentaethylene hexamine, and heavypolyamines (e.g. Dow HPA-X number average molecular weight of 275, available from Dow Chemical Company, Midland, Mich.). Such amines encompass isomers, such as branched-chain polyamines, and the previously mentioned substituted polyamines, including hydrocarbyl-substituted polyamines. HPA-X heavy polyamine ("HPA-X") contains an average of approximately 6.5 amine nitrogen atoms per molecule. Such heavy polyamines generally afford excellent results.

Generally, the polyalkenyl-substituted succinic anhydride of formula I is reacted with the polyamine at a temperature of about 130° C. to about 220° C. and preferably from about 145° C. to about 175° C. The reaction can be carried out under an inert atmosphere, such as nitrogen or argon. The amount of anhydride of formula I employed in the reaction can range from about 30 to about 95 wt. % and preferably from about 40 to about 60 wt. %, based on the total weight of the reaction mixture.

Generally, the concentration of the one or more non-borated polyalkenyl bis-succinimide dispersants wherein the polyalkenyl substituent is derived from a polyalkene group having a number average molecular weight of from about 1500 to about 3000 in a marine diesel cylinder lubricating oil composition of the present invention is greater than about 0.25 wt. %, or greater than about 0.5 wt. %, or greater than about 1.0 wt. %, or greater than about 1.2 wt. %, or greater than about 1.5 wt. %, or greater than about 1.8 wt. %, or greater than about 2.0 wt. %, or greater than about 2.5 wt. %, or greater than about 2.8 wt. %, on an active basis, based on the total weight of the marine diesel cylinder lubricating oil composition. In another embodiment, the amount of the one or more non-borated polyalkenyl bis-succinimide dispersants wherein the polyalkenyl substituent is derived from a polyalkene group having a number average molecular weight of from about 1500 to about 3000 present in a marine diesel cylinder lubricating oil composition of the present invention can range from about 0.25 to 10 wt. %, or about 0.25 to 8.0 wt. %, or about 0.25 to 5.0 wt. %, or about 0.25 to 4.0 wt. %, or 0.25 to 3.0 wt. %, or about 0.5 to 10 wt. %, or about 0.5 to 8.0 wt. %, or about 0.5 to 5.0 wt. %, or about 0.5 to 4.0 wt. %, or about 0.5 to 3.0 wt. %, or about 0.5 to 10 wt. %, or about 0.5 to 8.0 wt. %, or about 1.0 to 5.0 wt. %, or about 1.0 to 4.0 wt. %, or about 1.0 to 3.0 wt. %, or about 1.5 to 10 wt. %, or about 1.5 to 8.0 wt. %, or about 1.5 to 5.0 wt. %, or about 1.5 to 4.0 wt. %, or about 1.5 to 3.0 wt. %, or about 2.0 to 10 wt. %, or about 2.0 to 8.0 wt. %, or about 2.0 to 5.0 wt. % or about 2.0 to 4.0 wt. % on an active basis, based on the total weight of the marine diesel cylinder lubricating oil composition.

In another embodiment, the marine diesel cylinder lubricating oil composition of the present invention further includes a cyclic carbonate post-treated polyalkenyl bis-succinimide dispersant. The polyalkenyl bis-succinimide dispersant of this embodiment can be prepared as described above, i.e., the reaction of a polyalkenyl-substituted succinic anhydride with a polyamine.

In this embodiment, the polyalkenyl-substituted succinic anhydride can be a polyalkenyl-substituted succinic anhydride wherein the polyalkenyl substituent is derived from a polyalkene having a number average molecular weight of from about 500 to about 5000. In another embodiment, the polyalkenyl-substituted succinic anhydride according to the present embodiment can be a polyalkenyl-substituted succinic anhydride wherein the polyalkenyl substituent is derived from a polyalkene having a number average molecular weight of from about 700 to about 3000. In another embodiment, the polyalkenyl-substituted succinic anhydride according to the present embodiment can be a polyalkenyl-substituted succinic anhydride wherein the polyalkenyl substituent is derived from a polyalkene having a number average molecular weight of from about 1000 to about 3000. In another embodiment, the polyalkenyl-substituted succinic anhydride according to the present embodiment can be a polyalkenyl-substituted succinic anhydride wherein the polyalkenyl substituent is derived from a polyalkene having a number average molecular weight of from about 1300 to about 2500. In another embodiment, the polyalkenyl-substituted succinic anhydride according to the present embodiment can be a polyalkenyl-substituted succinic anhydride wherein the polyalkenyl substituent is derived from a polyalkene having a number average molecular weight of from about 1000 to about 2500. In another embodiment, the polyalkenyl-substituted succinic anhydride according to the present embodiment can be a polyalkenyl-substituted succinic anhydride wherein the polyalkenyl substituent is derived from a polyalkene having a number average molecular weight of from about 1500 to about 2500. In another embodiment, the polyalkenyl-substituted succinic anhydride according to the present embodiment can be a polyalkenyl-substituted succinic anhydride wherein the polyalkenyl substituent is derived from a polyalkene having a number average molecular weight of from about 2000 to about 2500.

The polyalkene groups for forming the polyalkenyl-substituted succinic anhydrides of this embodiment can be any of those discussed above. A particularly preferred class of polyalkene groups include polybutenes, which are prepared by polymerization of one or more of 1-butene, 2-butene and isobutene. Especially desirable are polybutenes containing a substantial proportion of units derived from isobutene.

The polyalkenyl bis-succinimide dispersants of this embodiment is post-treated with a cyclic carbonate to form a cyclic carbonate post-treated polyalkenyl bis-succinimide dispersants. Suitable cyclic carbonates for use in this invention include, but are not limited to, 1,3-dioxolan-2-one (ethylene carbonate): 4-methyl-1,3-dioxolan-2-one (propylene carbonate); 4-hydroxymethyl-1,3-dioxolan-2-one: 4,5-dimethyl-1,3-dioxolan-2-one; 4-ethyl-1,3-dioxolan-2-one (butylene carbonate): 4,4-dimethyl-1,3-dioxolan-2-one: 4-methyl-5-ethyl-1,3-dioxolan-2-one; 4,5-diethyl-1,3-dioxolan-2-one; 4,4-diethyl-1,3-dioxolan-2-one; 1,3-dioxan-2-one; 44-dimethyl-1,3-dioxan-2-one; 5,5-dimethyl-1,3-dioxan-2-one: 5,5-dihydroxymethyl-1,3-dioxan-2-one; 5-methyl-1,3-dioxan-2-one; 4-methyl-1,3-dioxan-2-one, 5-hydroxy-1,3-dioxan-2-one; 5-hydroxymethyl-5-methyl-1,3-dioxan-2-one; 5,5-diethyl-1,3-dioxan-2-one; 5-methyl-5-propyl-1,3-dioxan-2-one; 4,6-dimethyl-1,3-dioxan-2-one; 4,4,6-trimethyl-1,3-dioxan-2-one, spiro[1,3-oxa-2-cyclohexanone-5,5'-1',3'-oxa-2'-cyclohexanone] and the like. Other suitable cyclic carbonates may be prepared from saccharides such as sorbitol, glucose, fructose, galactose and the like and from vicinal diols prepared from $C_1$ to $C_{30}$ olefins by methods known in the art.

Several of these cyclic carbonates are commercially available such as 1,3-dioxolan-2-one or 4-methyl-1,3-dioxolan-2-one. Alternatively, cyclic carbonates may be readily prepared by known reactions. For example, reaction of phosgene with a suitable alpha alkane diol or an alkane-1,3-diol yields a cyclic carbonate for use of this invention, see. e.g., U.S. Pat. No. 4,115,206, the contents of which are incorporated by reference herein. Likewise, the cyclic carbonates useful for this invention may be prepared by transesterification of a suitable alpha alkane diol or an alkane-1,3-diol with, e.g., diethyl carbonate under transesterification conditions, see, e.g., U.S. Pat. Nos. 4,384,115 and 4,423,205, the contents of which are incorporated by reference herein.

The polyalkenyl bis-succinimide dispersant can be post-treated with the cyclic carbonate according to methods well known in the art. For example, a cyclic carbonate post-treated polyalkenyl bis-succinimide dispersant can be prepared by a process comprising charging the bis-succinimide dispersant in a reactor, optionally under a nitrogen purge, and heating at a temperature of from about 80° C. to about 170° C. Optionally, diluent oil may be charged under a nitrogen purge in the same reactor. A cyclic carbonate is charged, optionally under a nitrogen purge, to the reactor. This mixture is heated under a nitrogen purge to a temperature in range from about 130° C. to about 200° C. Optionally, a vacuum is applied to the mixture for about 0.5 to about 2.0 hours to remove any water formed in the reaction.

Generally, the amount of the one or more cyclic carbonate post-treated polyalkenyl bis-succinimide dispersants present in a marine diesel cylinder lubricating oil composition of the present invention is greater than about 0.25 wt. %, or greater than about 0.5 wt. %, or greater than about 1.0 wt. %, or greater than about 1.2 wt. %, or greater than about 1.5 wt. %, or greater than about 1.8 wt. %, or greater than about 2.0 wt. %, or greater than about 2.5 wt. %, or greater than about 2.8 wt. %, on an active basis, based on the total weight of the marine diesel cylinder lubricating oil composition. In another embodiment, the amount of the one or more cyclic carbonate post-treated polyalkenyl bis-succinimide dispersants present in a marine diesel cylinder lubricating oil composition of the present invention can range from about 0.25 to 10 wt. %, or about 0.25 to 8.0 wt. %, or about 0.25 to 5.0 wt. %, or about 0.25 to 4.0 wt. %, or 0.25 to 3.0 wt. %, or about 0.5 to 10 wt. %, or about 0.5 to 8.0 wt. %, or about 0.5 to 5.0 wt. %, or about 0.5 to 4.0 wt. %, or about 0.5 to 3.0 wt. %, or about 0.5 to 10 wt. %, or about 0.5 to 8.0 wt. %, or about 1.0 to 5.0 wt. %, or about 1.0 to 4.0 wt. %, or about 1.0 to 3.0 wt. %, or about 1.5 to 10 wt. %, or about 1.5 to 8.0 wt. %, or about 1.5 to 5.0 wt. %, or about 1.5 to 4.0 wt. %, or about 1.5 to 3.0 wt. %, or about 2.0 to 10 wt. %, or about 2.0 to 8.0 wt. %, or about 2.0 to 5.0 wt. % or about 2.0 to 4.0 wt. % on an active basis, based on the total weight of the marine diesel cylinder lubricating oil composition.

The marine diesel cylinder lubricating oil compositions of the present invention may also contain conventional marine diesel cylinder lubricating oil composition additives, other than the foregoing dispersants, for imparting auxiliary functions to give a marine diesel cylinder lubricating oil composition in which these additives are dispersed or dissolved. For example, the marine diesel cylinder lubricating oil compositions can be blended with antioxidants, detergents, anti-wear agents, rust inhibitors, dehazing agents, demulsifying agents, metal deactivating agents, friction modifiers, pour point depressants, antifoaming agents, co-solvents, corrosion-inhibitors, dyes, extreme pressure agents and the like and mixtures thereof. A variety of the additives are known and commercially available. These additives, or their analogous compounds, can be employed for the preparation of the marine diesel cylinder lubricating oil compositions of the invention by the usual blending procedures.

In one embodiment, the marine diesel cylinder lubricating oil compositions of the present invention contain essentially no thickener (i.e., a viscosity index improver).

The marine diesel cylinder lubricating oil composition of the present invention can contain one or more antioxidants that can reduce or prevent the oxidation of the base oil. Any antioxidant known by a person of ordinary skill in the art may be used in the lubricating oil composition. Non-limiting examples of suitable antioxidants include amine-based antioxidants (e.g., alkyl diphenylamines such as bis-nonylated diphenylamine, bis-octylated diphenylamine, and octylated/butylated diphenylamine, phenyl-α-naphthylamine, alkyl or arylalkyl substituted phenyl-α-naphthylamine, alkylated p-phenylene diamines, tetramethyl-diaminodiphenylamine and the like), phenolic antioxidants (e.g., 2-tert-butylphenol, 4-methyl-2,6-di-tert-butylphenol, 2,4,6-tri-tert-butylphenol, 2,6-di-tert-butyl-p-cresol, 2,6-di-tert-butylphenol, 4,4'-methylenebis-(2,6-di-tert-butylphenol), 4,4'-thiobis(6-di-tert-butyl-o-cresol) and the like), sulfur-based antioxidants (e.g., dilauryl-3,3'-thiodipropionate, sulfurized phenolic antioxidants and the like), phosphorous-based antioxidants (e.g., phosphites and the like), zinc dithiophosphate, oil-soluble copper compounds and combinations thereof.

The amount of the antioxidant may vary from about 0.01 wt. % to about 10 wt. %, from about 0.05 wt. % to about 5 wt. %, or from about 0.1 wt. % to about 3 wt. %, based on the total weight of the marine diesel cylinder lubricating oil composition.

The marine diesel cylinder lubricating oil composition of the present invention can contain one or more detergents. Metal-containing or ash-forming detergents function as both detergents to reduce or remove deposits and as acid neutralizers or rust inhibitors, thereby reducing wear and corrosion and extending engine life. Detergents generally comprise a polar head with a long hydrophobic tail. The polar head comprises a metal salt of an acidic organic compound. The salts may contain a substantially stoichiometric amount of the metal in which case they are usually described as normal or neutral salts. A large amount of a metal base may be incorporated by reacting excess metal compound (e.g., an oxide or hydroxide) with an acidic gas (e.g., carbon dioxide).

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., barium, sodium, potassium, lithium, calcium, and magnesium. The most commonly used metals are calcium and magnesium, which may both be present in detergents used in a lubricant, and mixtures of calcium and/or magnesium with sodium.

Commercial products are generally referred to as neutral or overbased. Overbased metal detergents are generally produced by carbonating a mixture of hydrocarbons, detergent acid, for example: sulfonic acid, carboxylate etc., metal oxide or hydroxides (for example calcium oxide or calcium hydroxide) and promoters such as xylene, methanol and water. For example, for preparing an overbased calcium sulfonate, in carbonation, the calcium oxide or hydroxide reacts with the gaseous carbon dioxide to form calcium carbonate. The sulfonic acid is neutralized with an excess of CaO or $Ca(OH)_2$, to form the sulfonate.

Overbased detergents may be low overbased, e.g., an overbased salt having a BN below 100. In one embodiment, the BN of a low overbased salt may be from about 5 to about 50. In another embodiment, the BN of a low overbased salt may be from about 10 to about 30. In yet another embodiment, the BN of a low overbased salt may be from about 15 to about 20.

Overbased detergents may be medium overbased, e.g., an overbased salt having a BN from about 100 to about 250. In one embodiment, the BN of a medium overbased salt may be from about 100 to about 200. In another embodiment, the BN of a medium overbased salt may be from about 125 to about 175.

Overbased detergents may be high overbased, e.g., an overbased salt having a BN above 250. In one embodiment, the BN of a high overbased salt may be from about 250 to about 550.

In one embodiment, the detergent can be one or more alkali or alkaline earth metal salts of an alkyl-substituted hydroxyaromatic carboxylic acid. Suitable hydroxyaromatic compounds include mononuclear monohydroxy and polyhydroxy aromatic hydrocarbons having 1 to 4, and preferably 1 to 3, hydroxyl groups. Suitable hydroxyaromatic compounds include phenol, catechol, resorcinol, hydroquinone, pyrogallol, cresol, and the like. The preferred hydroxyaromatic compound is phenol.

The alkyl substituted moiety of the alkali or alkaline earth metal salt of an alkyl-substituted hydroxyaromatic carboxylic acid is derived from an alpha olefin having from about 10 to about 80 carbon atoms. The olefins employed may be linear, isomerized linear, branched or partially branched linear. The olefin may be a mixture of linear olefins, a mixture of isomerized linear olefins, a mixture of branched olefins, a mixture of partially branched linear or a mixture of any of the foregoing.

In one embodiment, the mixture of linear olefins that may be used is a mixture of normal alpha olefins selected from olefins having from about 12 to about 30 carbon atoms per molecule. In one embodiment, the normal alpha olefins are isomerized using at least one of a solid or liquid catalyst.

In another embodiment, the olefins are a branched olefinic propylene oligomer or mixture thereof having from about 20 to about 80 carbon atoms, i.e., branched chain olefins derived from the polymerization of propylene. The olefins may also be substituted with other functional groups, such as hydroxy groups, carboxylic acid groups, heteroatoms, and the like. In one embodiment, the branched olefinic propylene oligomer or mixtures thereof have from about 20 to about 60 carbon atoms. In one embodiment, the branched olefinic propylene oligomer or mixtures thereof have from about 20 to about 40 carbon atoms.

In one embodiment, at least about 75 mole % (e.g., at least about 80 mole %, at least about 85 mole %, at least about 90 mole %, at least about 95 mole %, or at least about 99 mole %) of the alkyl groups contained within the alkali or alkaline earth metal salt of an alkyl-substituted hydroxyaromatic carboxylic acid such as the alkyl groups of an alkaline earth metal salt of an alkyl-substituted hydroxybenzoic acid detergent are a $C_{20}$ or higher. In another embodiment, the alkali or alkaline earth metal salt of an alkyl-substituted hydroxyaromatic carboxylic acid is an alkali or alkaline earth metal salt of an alkyl-substituted hydroxybenzoic acid that is derived from an alkyl-substituted hydroxybenzoic acid in which the alkyl groups are the residue of normal alpha-olefins containing at least 75 mole % $C_{20}$ or higher normal alpha-olefins.

In another embodiment, at least about 50 mole % (e.g., at least about 60 mole %, at least about 70 mole %, at least about 80 mole %, at least about 85 mole %, at least about 90 mole %, at least about 95 mole %, or at least about 99 mole %) of the alkyl groups contained within the alkali or alkaline earth metal salt of an alkyl-substituted hydroxyaromatic carboxylic acid such as the alkyl groups of an alkali or alkaline earth metal salt of an alkyl-substituted hydroxybenzoic acid are about $C_{14}$ to about $C_{18}$.

The resulting alkali or alkaline earth metal salt of an alkyl-substituted hydroxyaromatic carboxylic acid will be a mixture of ortho and para isomers. In one embodiment, the product will contain about 1 to 99% ortho isomer and 99 to 1% para isomer. In another embodiment, the product will contain about 5 to 70% ortho and 95 to 30% para isomer.

The alkali or alkaline earth metal salts of an alkyl-substituted hydroxyaromatic carboxylic acid can be neutral or overbased. Generally, an overbased alkali or alkaline earth metal salt of an alkyl-substituted hydroxyaromatic carboxylic acid is one in which the BN of the alkali or alkaline earth metal salts of an alkyl-substituted hydroxyaromatic carboxylic acid has been increased by a process such as the addition of a base source (e.g., lime) and an acidic overbasing compound (e.g., carbon dioxide).

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to about 220 wt. % (preferably at least about 125 wt. %) of that stoichiometrically required.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

Generally, the amount of the detergent can be from about 0.001 wt. % to about 25 wt. %, or from about 0.05 wt. % to about 20 wt. %, or from about 0.1 wt. % to about 15 wt. %, based on the total weight of the marine diesel cylinder lubricating oil composition.

The marine diesel cylinder lubricating oil composition of the present invention can contain one or more friction modifiers that can lower the friction between moving parts. Any friction modifier known by a person of ordinary skill in the art may be used in the marine diesel cylinder lubricating oil composition. Non-limiting examples of suitable friction modifiers include fatty carboxylic acids; derivatives (e.g., alcohol, esters, borated esters, amides, metal salts and the like) of fatty carboxylic acid; mono-, di- or tri-alkyl substituted phosphoric acids or phosphonic acids; derivatives (e.g., esters, amides, metal salts and the like) of mono-, di- or tri-alkyl substituted phosphoric acids or phosphonic acids; mono-, di- or tri-alkyl substituted amines; mono- or di-alkyl substituted amides and combinations thereof. In some embodiments examples of friction modifiers include, but are not limited to, alkoxylated fatty amines; borated fatty epoxides; fatty phosphites, fatty epoxides, fatty amines, borated alkoxylated fatty amines, metal salts of fatty acids, fatty acid amides, glycerol esters, borated glycerol esters; and fatty imidazolines as disclosed in U.S. Pat. No. 6,372,696, the contents of which are incorporated by reference herein; friction modifiers obtained from a reaction product of a $C_4$ to $C_{75}$, or a $C_6$ to $C_{24}$, or a $C_6$ to $C_{20}$, fatty acid ester and a nitrogen-containing compound selected from the group consisting of ammonia, and an alkanolamine and the like and mixtures thereof.

The amount of the friction modifier may vary from about 0.01 wt. % to about 10 wt. %, from about 0.05 wt. % to about 5 wt. %, or from about 0.1 wt. % to about 3 wt. %, based on the total weight of the marine diesel cylinder lubricating oil composition.

The marine diesel cylinder lubricating oil composition of the present invention can contain one or more anti-wear agents that can reduce friction and excessive wear. Any anti-wear agent known by a person of ordinary skill in the art may be used in the lubricating oil composition. Non-limiting examples of suitable anti-wear agents include zinc dithiophosphate, metal (e.g., Pb, Sb, Mo and the like) salts of dithiophosphates, metal (e.g., Zn, Pb, Sb, Mo and the like) salts of dithiocarbamates, metal (e.g., Zn, Pb, Sb and the like) salts of fatty acids, boron compounds, phosphate esters, phosphite esters, amine salts of phosphoric acid esters or thiophosphoric acid esters, reaction products of dicyclopentadiene and thiophosphoric acids and combinations thereof.

The amount of the anti-wear agent may vary from about 0.01 wt. % to about 5 wt. %, or from about 0.05 wt. % to about 3 wt. %, or from about 0.1 wt. % to about 1 wt. %, based on the total weight of the marine diesel cylinder lubricating oil composition.

In certain embodiments, the anti-wear agent is or comprises a dihydrocarbyl dithiophosphate metal salt, such as zinc dialkyl dithiophosphate compounds. The metal of the dihydrocarbyl dithiophosphate metal salt may be an alkali or alkaline earth metal, or aluminum, lead, tin, molybdenum, manganese, nickel or copper. In some embodiments, the metal is zinc. In other embodiments, the alkyl group of the dihydrocarbyl dithiophosphate metal salt has from about 3 to about 22 carbon atoms, from about 3 to about 18 carbon atoms, from about 3 to about 12 carbon atoms, or from about 3 to about 8 carbon atoms. In further embodiments, the alkyl group is linear or branched.

The amount of the dihydrocarbyl dithiophosphate metal salt including the zinc dialkyl dithiophosphate salts in the lubricating oil composition disclosed herein is measured by its phosphorus content. In some embodiments, the phosphorus content of the lubricating oil composition disclosed herein is from about 0.01 wt. % to about 0.14 wt., based on the total weight of the lubricating oil composition.

The marine diesel cylinder lubricating oil composition of the present invention can contain one or more foam inhibitors or anti-foam inhibitors that can break up foams in oils. Any foam inhibitor or anti-foam known by a person of ordinary skill in the art may be used in the marine diesel cylinder lubricating oil composition. Non-limiting examples of suitable foam inhibitors or anti-foam inhibitors include silicone oils or polydimethylsiloxanes, fluorosilicones, alkoxylated aliphatic acids, polyethers (e.g., polyethylene glycols), branched polyvinyl ethers, alkyl acrylate polymers, alkyl methacrylate polymers, polyalkoxyamines and combinations thereof. In some embodiments, the foam inhibitors or anti-foam inhibitors comprises glycerol monostearate, polyglycol palmitate, a trialkyl monothiophosphate, an ester of sulfonated ricinoleic acid, benzoylacetone, methyl salicylate, glycerol monooleate, or glycerol dioleate.

The amount of the foam inhibitors or anti-foam inhibitors may vary from about 0.001 wt. % to about 5 wt. %, or from about 0.05 wt. % to about 3 wt. %, or from about 0.1 wt. % to about 1 wt. %, based on the total weight of the marine diesel cylinder lubricating oil composition.

The marine diesel cylinder lubricating oil composition of the present invention can contain one or more pour point depressants that can lower the pour point of the marine diesel cylinder lubricating oil composition. Any pour point depressant known by a person of ordinary skill in the art may be used in the marine diesel cylinder lubricating oil composition. Non-limiting examples of suitable pour point depressants include polymethacrylates, alkyl acrylate polymers, alkyl methacrylate polymers, di(tetra-paraffin phenol) phthalate, condensates of tetra-paraffin phenol, condensates of a chlorinated paraffin with naphthalene and combinations thereof. In some embodiments, the pour point depressant comprises an ethylene-vinyl acetate copolymer, a condensate of chlorinated paraffin and phenol, polyalkyl styrene or the like.

The amount of the pour point depressant may vary from about 0.01 wt. % to about 10 wt. %, or from about 0.05 wt. % to about 5 wt. %, or from about 0.1 wt. % to about 3 wt. %, based on the total weight of the marine diesel cylinder lubricating oil composition.

In one embodiment, the marine diesel cylinder lubricating oil composition of the present invention does not contain one or more demulsifiers. In another embodiment, the marine diesel cylinder lubricating oil composition of the present invention can contain one or more demulsifiers that can promote oil-water separation in lubricating oil compositions that are exposed to water or steam. Any demulsifier known by a person of ordinary skill in the art may be used in the marine diesel cylinder lubricating oil composition. Non-limiting examples of suitable demulsifiers include anionic surfactants (e.g., alkyl-naphthalene sulfonates, alkyl benzene sulfonates and the like), nonionic alkoxylated alkyl phenol resins, polymers of alkylene oxides (e.g., polyethylene oxide, polypropylene oxide, block copolymers of ethylene oxide, propylene oxide and the like), esters of oil soluble acids, polyoxyethylene sorbitan ester and combinations thereof.

The amount of the demulsifier may vary from about 0.01 wt. % to about 10 wt. %, or from about 0.05 wt. % to about 5 wt. %, or from about 0.1 wt. % to about 3 wt. %, based on the total weight of the marine diesel cylinder lubricating oil composition.

The marine diesel cylinder lubricating oil composition of the present invention can contain one or more corrosion inhibitors that can reduce corrosion. Any corrosion inhibitor known by a person of ordinary skill in the art may be used in the marine diesel cylinder lubricating oil composition. Non-limiting examples of suitable corrosion inhibitor include half esters or amides of dodecylsuccinic acid, phosphate esters, thiophosphates, alkyl imidazolines, sarcosines and combinations thereof.

The amount of the corrosion inhibitor may vary from about 0.01 wt. % to about 5 wt. %, or from about 0.05 wt. % to about 3 wt. %, or from about 0.1 wt. % to about 1 wt. %, based on the total weight of the marine diesel cylinder lubricating oil composition.

The marine diesel cylinder lubricating oil composition of the present invention can contain one or more extreme pressure (EP) agents that can prevent sliding metal surfaces from seizing under conditions of extreme pressure. Any extreme pressure agent known by a person of ordinary skill in the art may be used in the marine diesel cylinder lubricating oil composition. Generally, the extreme pressure agent is a compound that can combine chemically with a metal to form a surface film that prevents the welding of asperities in opposing metal surfaces under high loads. Non-limiting examples of suitable extreme pressure agents include sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and polysulfide olefin products, amine salts of phosphoric acid esters or thiophosphoric acid esters and combinations thereof.

The amount of the extreme pressure agent may vary from about 0.01 wt. % to about 5 wt. %, or from about 0.05 wt. % to about 3 wt. %, or from about 0.1 wt. % to about 1 wt. %, based on the total weight of the marine diesel cylinder lubricating oil composition.

The marine diesel cylinder lubricating oil composition of the present invention can contain one or more rust inhibitors that can inhibit the corrosion of ferrous metal surfaces. Any rust inhibitor known by a person of ordinary skill in the art may be used in the marine diesel cylinder lubricating oil composition. Non-limiting examples of suitable rust inhibitors include nonionic polyoxyalkylene agents, e.g., polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate; stearic acid and other fatty acids; dicarboxylic acids; metal soaps; fatty acid amine salts; metal salts of heavy sulfonic acid; partial carboxylic acid ester of polyhydric alcohol; phosphoric esters; (short-chain) alkenyl succinic acids; partial esters thereof and nitrogen-containing derivatives thereof synthetic alkarylsulfonates, e.g., metal dinonylnaphthalene sulfonates; and the like and mixtures thereof.

The amount of the rust inhibitor may vary from about 0.01 wt. % to about 10 wt. %, or from about 0.05 wt. % to about 5 wt. %, or from about 0.1 wt. % to about 3 wt. %, based on the total weight of the marine diesel cylinder lubricating oil composition.

The marine diesel cylinder lubricating oil composition of the present invention can contain one or more multifunctional additives. Non-limiting examples of suitable multifunctional additives include sulfurized oxymolybdenum dithiocarbamate, sulfurized oxymolybdenum organophosphorodithioate, oxymolybdenum monoglyceride, oxymolybdenum diethylate amide, amine-molybdenum complex compound, and sulfur-containing molybdenum complex compound.

The marine diesel cylinder lubricating oil composition of the present invention can contain one or more viscosity index improvers. Non-limiting examples of suitable viscosity index improvers include, but are not limited to, olefin copolymers, such as ethylene-propylene copolymers, styrene-isoprene copolymers, hydrated styrene-isoprene copolymers, polybutene, polyisobutylene, polymethacrylates, vinylpyrrolidone and methacrylate copolymers and dispersant type viscosity index improvers. These viscosity modifiers can optionally be grafted with grafting materials such as, for example, maleic anhydride, and the grafted material can be reacted with, for example, amines, amides, nitrogen-containing heterocyclic compounds or alcohol, to form multifunctional viscosity modifiers (dispersant-viscosity modifiers). Other examples of viscosity modifiers include star polymers (e.g., a star polymer comprising isoprene/styrene/isoprene triblock). Yet other examples of viscosity modifiers include poly alkyl(meth)acrylates of low Brookfield viscosity and high shear stability, functionalized poly alkyl(meth)acrylates with dispersant properties of high Brookfield viscosity and high shear stability, polyisobutylene having a weight average molecular weight ranging from 700 to 2,500 Daltons and mixtures thereof.

The amount of the viscosity index improvers may vary from about 0.01 wt. % to about 25 wt. %, or from about 0.05 wt. % to about 20 wt. %, or from about 0.3 wt. % to about 15 wt. %, based on the total weight of the marine diesel cylinder lubricating oil composition.

The marine diesel cylinder lubricating oil composition of the present invention can contain one or more metal deactivators. Non-limiting examples of suitable metal deactivators include disalicylidene propylenediamine, triazole derivatives, thiadiazole derivatives, and mercaptobenzimidazoles.

In addition, the foregoing marine diesel cylinder lubricating oil composition additives may be provided as an additive package or concentrate in which the additives are incorporated into a substantially inert, normally liquid organic diluent as described above. The additive package will typically contain one or more of the various additives, referred to above, in the desired amounts and ratios to facilitate direct combination with the requisite amount of the oil of lubricating viscosity.

The following non-limiting examples are illustrative of the present invention.

The advantages of the present invention were demonstrated by evaluating Group I and Group II based marine cylinder lubricating oil compositions containing varying succinimide dispersants in a baseline formulation against lubricating oil compositions containing the same baseline formulation without any dispersant.

The degree of stability against oxidation-based viscosity increase of the marine cylinder lubricating oil compositions of the present invention was evaluated using the Modified Institute of Petroleum 48 ("MIP-48") Test.

Modified Institute of Petroleum 48 (MIP-48) Test

The MIP-48 Test consists of a thermal and an oxidative part. During both parts of the test the test samples are heated for a period of time. In the thermal part of the test, nitrogen is passed through a heated oil sample for 24 hours and in parallel during the oxidative part of the test, air is passed through a heated oil sample for 24 hours. The samples were cooled and the viscosities of both samples were determined. The viscosity increase of the test oil caused by oxidation is determined and corrected for the thermal effect. The oxidation-based viscosity increase for each marine cylinder lubricating oil composition was calculated by subtracting the kinematic viscosity at 200° C. for the nitrogen-blown sample from the kinematic viscosity at 200° C. for the air-blown sample, and dividing the subtraction product by the kinematic viscosity at 200° C. for the nitrogen blown sample. This is done to correct for potential evaporation effects during the test, or any other thermal effect, thereby focusing on the impact of oxidation. This correction may result in a negative value. Test oils which exhibit better stability against oxidation-based viscosity increase will result in a lower % value.

In addition, the ability of the marine cylinder lubricating oil compositions of the present invention to control foaming was evaluated using the following Foam Test.

Foam Test

Summary of Test Method

This test method covers the determination of the foaming characteristics of lubricating oils at 24° C. and 93.5° C. The sample, maintained at a temperature of 24° C. (75° F.) is blown with air at a constant rate for 5 min, then allowed to settle for 10 min ("Sequence I"). The volume of foam is measured at the end of both periods. The test is repeated on a second sample at 93.5° C. (200° F.) ("Sequence II"), and then, after collapsing the foam, at 24° C. (75° F.) ("Sequence III").

Significance and Use

The tendency of oils to foam can be a serious problem in systems such as high-speed gearing, high-volume pumping, and splash lubrication. Inadequate lubrication, cavitation, and overflow loss of lubricant can lead to mechanical failure. This test method is used in the evaluation of oils for such operating conditions.

The following components are used below in formulating a marine diesel cylinder lubricating oil composition.

ExxonMobil CORE® 150N: Group I-based lubricating oil, available from ExxonMobil (Irving, Tex.).

ExxonMobil CORE® 600N: Group I-based lubricating oil, available from ExxonMobil (Irving, Tex.).

Esso Core® 2500BS: Group I brightstock, available from ExxonMobil (Irving, Tex.).

Chevron 600N: Group II-based lubricating oil, available from Chevron Corporation (San Ramon, Calif.).

Chevron RLOP 100: Group II-based lubricating oil, available from Chevron Corporation (San Ramon, Calif.).

The succinimide dispersants used in the following examples are described below:

Dispersant A: An oil concentrate of a predominantly bis-succinimide dispersant derived from polyisobutylene having a number average molecular weight (Mn) of 1000 and heavy polyamine/diethylenetriamine (80/20 wt/wt). This additive contains 2.0% nitrogen, about 32% diluent oil and has a TBN of 38 mg·KOH/g.

Dispersant B: An oil concentrate of a predominantly bis-succinimide dispersant derived from polyisobutylene having a Mn of 1300 and heavy polyamine/diethylenetriamine (80/20 wt/wt). This additive contains 1.45% nitrogen, about 39% diluent oil and has a TBN of 27 mg·KOH/g.

Dispersant C: An oil concentrate of a borated post-treated predominantly bis-succinimide dispersant derived from polyisobutylene having a Mn of 1300 and heavy polyamine. This additive contains 1.95% nitrogen, 0.63% boron, about 37% diluent oil and has a TBN of 43 mg·KOH/g.

Dispersant D: An oil concentrate of an ethylene carbonate post-treated predominantly bis-succinimide dispersant derived from polyisobutylene having a Mn of 2300 and heavy polyamine. This additive contains 1.0% nitrogen, about 43% diluent oil (about 57% actives) and has a TBN of 12.5 mg·KOH/g.

Dispersant E: An oil concentrate of a bis-succinimide dispersant derived from polyisobutylene having a Mn of 2300 and heavy polyamine. This additive contains 1.25% nitrogen, about 42% diluent oil and has a TBN of 29 mg KOH/g. This dispersant is the succinimide precursor to Dispersant D before the post-treatment step with ethylene carbonate.

The amounts of dispersant concentration indicated in the tables below are based on the amount of oil concentrate added to the formulation, not the amount of active dispersant. The dispersants were added to the compositions at an equal molar basis, determined by the moles of amine which makes up the core of the bis-succinimide dispersant, so that the amount of Dispersants A, B, C, and E in the Examples were equivalent on a molar basis to 5.0 wt. % (2.9 wt. % actives) of Dispersant D. Dispersant D was then downtreated in some examples to 2.5 wt. % and 3.5 wt. % additive concentrate (1.4 wt. % actives and 2.0 wt. % actives respectively) in order to evaluate for critical concentration levels.

Examples 1-7 and Comparative Examples 1-5

The marine cylinder lubricating oil compositions of Examples 1-7 and Comparative Examples 1-5 were prepared as set forth below in Table 1. Each marine cylinder lubricating oil composition was formulated to a SAE 50 viscosity grade using a majority amount of Group I basestock. Marine Cylinder Lubricating oil compositions of Examples 5 and 7 included the following additives: an oil concentrate of a 114 BN sulfurized calcium alkyl phenate detergent, an oil concentrate of a 260 BN sulfurized calcium alkyl phenate detergent, an oil concentrate of a 410 BN high overbased alkyl aromatic calcium sulfonate detergent, a secondary zinc dialkyldithiophosphate and foam inhibitor. The Marine Cylinder Lubricating oil compositions of the remaining examples of Table 1 included the following additives: an oil concentrate of a 114 BN sulfurized calcium alkyl phenate detergent, an oil concentrate of a 150 BN overbased detergent comprising a calcium salt of a linear alkyl-substituted hydroxybenzoic acid, an oil concentrate of a 410 BN high overbased alkyl aromatic calcium sulfonate detergent, and foam inhibitor. Comparative Example 1 did not contain any succinimide dispersant and is the reference oil. The amount of dispersant in Comparative Examples 3, 4 and 5 and Inventive Examples 6 and 7 are equivalent to 5.0 wt. % Dispersant D at an equal molar basis. Examples 6 and 7 contain a higher molecular weight succinimide dispersant which has not been post-treated with ethylene carbonate.

TABLE 1

SAE 50 Marine Cylinder Lubricating Oil Compositions

| | Comp. Ex. 1 | Comp. Ex. 2 | Ex. 1 | Ex. 2 | Ex. 3 | Ex. 4 | Ex. 5 | Ex. 6 | Ex. 7 | Comp. Ex. 3 | Comp. Ex. 4 | Comp. Ex. 5 |
|---|---|---|---|---|---|---|---|---|---|---|---|---|
| Dispersant A, wt. % | — | — | — | — | — | — | — | — | — | — | — | 2.0 |
| Dispersant B, wt. % | — | — | — | — | — | — | — | — | — | 2.7 | — | — |
| Dispersant C, wt. % | — | — | — | — | — | — | — | — | — | — | 2.6 | — |
| Dispersant D, wt. % | — | 2.5 | 3.5 | 5.0 | 2.5 | 5.0 | 5.0 | — | — | — | — | — |
| Dispersant E, wt. % | — | — | — | — | — | — | — | 3.85 | 3.85 | — | — | — |
| Esso 600N, wt. % | 47 | — | 62 | 69 | 70 | 42 | 30 | 65 | 53 | 61 | 60 | 51 |
| Esso 150N, wt. % | — | 68 | — | — | 2 | 27 | 33 | 11 | 11 | — | — | — |
| Chevron 600N, wt. % | — | — | — | — | — | — | — | — | — | — | — | — |
| Esso Core 2500 BS, wt. % | 37 | 13 | 18 | 9 | — | — | — | — | — | 20 | 21 | 31 |
| Base Number, mgKOH/g | 30 | 30 | 30 | 30 | 70 | 70 | 100 | 70 | 100 | 30 | 30 | 30 |
| Modified IP-48 vis increase, % | 12.0 | 18.0 | 17.7 | 5.1 | 8.9 | 3.2 | −2.9 | 11.3 | 9.6 | 6.1 | 11.2 | 9.8 |
| Foam tendency, ml | 150 | 140 | 20 | 20 | 30 | 10 | 10 | 10 | 10 | 60 | 60 | 70 |

As the results set forth in Table 1 show, the marine diesel cylinder lubricating oil composition of Examples 1-7 exhibited surprisingly better or equivalent stability against oxidation-based viscosity increase, as is evident by equivalent or lower % vis increase as measured by the MIP-48 test, over Group I based cylinder lubricants of Comparative Examples 1-5, and the foaming tendency of the marine diesel cylinder lubricating oil compositions of Examples 1-7 was significantly improved over the comparative examples. In addition, the marine diesel cylinder lubricating oil compositions of Examples 1-7 achieved the desired viscosities using less brightstock (indicated in the examples as Esso Core 2500 BS) than the marine diesel cylinder lubricating oil compositions of the comparative examples.

Examples 8-12 and Comparative Examples 6-9

The marine cylinder lubricating oil compositions of Examples 8-12 and Comparative Examples 6-9 were prepared as set forth below in Table 2. Each marine cylinder lubricating oil composition was formulated to a SAE 50 viscosity grade using a majority amount of Group II basestock. Marine Cylinder Lubricating oil composition of Example 12 further included: an oil concentrate of a 114 BN sulfurized calcium alkyl phenate detergent, an oil concentrate of a 260 BN sulfurized calcium alkyl phenate detergent, an oil concentrate of a 410 BN high overbased alkyl aromatic calcium sulfonate detergent, a secondary zinc dialkyldithiophosphate and foam inhibitor. The Marine Cylinder Lubricating oil compositions of the remaining examples of Table 2 included the following additives: an oil concentrate of a 114 BN sulfurized calcium alkyl phenate detergent, an oil concentrate of a 150 BN overbased detergent comprising a calcium salt of a linear alkyl-substituted hydroxybenzoic acid, an oil concentrate of a 410 BN high overbased alkyl aromatic calcium sulfonate detergent, and foam inhibitor. Comparative Example 6 did not contain any succinimide dispersant and is the reference oil. The amount of dispersant in Comparative Examples 7, 8 and 9 are equivalent to 5.0 wt. % Dispersant D at an equal molar basis.

TABLE 2

SAE 50 Marine Cylinder Lubricating Oil Compositions

| | Comp. Ex. 6 | Ex. 8 | Ex. 9 | Ex. 10 | Ex. 11 | Ex. 12 | Comp. Ex. 7 | Comp. Ex. 8 | Comp. Ex. 9 |
|---|---|---|---|---|---|---|---|---|---|
| Dispersant A, wt. % | — | — | — | — | — | — | — | — | 2.0 |
| Dispersant B, wt. % | — | — | — | — | — | — | 2.7 | — | — |
| Dispersant C, wt. % | — | — | — | — | — | — | — | 2.6 | — |
| Dispersant D, wt. % | — | 2.5 | 5.0 | 2.5 | 5.0 | 5.0 | — | — | — |
| Esso 600N, wt. % | — | — | — | — | — | — | — | — | — |
| Chevron RLOP 100, wt. % | — | — | — | — | 18 | 5 | — | — | — |
| Chevron 600N, wt. % | 47 | 64 | 69 | 70 | 50 | 59 | 61 | 60 | 51 |
| Esso Core 2500 BS, wt. % | 37 | 17 | 9 | 2 | — | — | 20 | 21 | 31 |
| Base Number, mg · KOH/g | 30 | 30 | 30 | 70 | 70 | 100 | 30 | 30 | 30 |
| Modified IP-48 vis increase, % | 11.3 | 5.0 | 2.9 | 0.4 | −4.1 | −6.6 | 3.7 | 6.0 | 7.7 |
| Foam tendency, ml | 130 | 50 | 10 | 30 | 10 | 10 | 40 | 30 | 50 |

As the results set forth in Table 2 show, the marine diesel cylinder lubricating oil compositions of Examples 9, 11 and 12 exhibited surprisingly better stability against oxidation-based viscosity increase, as is evident by the lower % vis increase as measured by the MIP-48 test, over Group II based marine diesel cylinder lubricating oil compositions of Comparative Examples 6-9, and the foaming tendency of the marine diesel cylinder lubricating oil compositions of Example 9, 11 and 12 were significantly better than the comparative examples. Examples 8 and 10 of the invention resulted in improved viscosity increase performance and about equivalent foam performance than the comparative examples using about half the molar equivalent of dispersant. In addition, the marine diesel cylinder lubricating oil compositions of Examples 8-12 achieved the desired viscosities using less brightstock than the marine diesel cylinder lubricating oil compositions of the comparative examples.

Examples 13-14 and Comparative Examples 10-14

The marine cylinder lubricating oil compositions of Examples 13-14 and Comparative Examples 10-14 were prepared as set forth below in Table 3. Each marine cylinder lubricating oil composition was formulated to a SAE 50 viscosity grade oil using a major amount of Group I basestock. Each of the marine cylinder lubricating oil compositions further included the following additives: an oil concentrate of a 410 BN high overbased alkyl aromatic calcium sulfonate detergent, an oil concentrate of a 19 BN non-overbased alkyl aromatic calcium sulfonate detergent, a secondary zinc dialkyldithiophosphates, aminic anti-oxidant and foam inhibitor. Comparative Example 10 did not contain any succinimide dispersant and is the reference oil. The amount of dispersant in Comparative Examples 12, 13 and 14 are equivalent to 5.0 wt. % Dispersant D at an equal molar basis.

TABLE 3

SAE 50 Marine Cylinder Lubricating Oil Compositions

| | Comp. Ex. 10 | Comp. Ex. 11 | Ex. 13 | Ex. 14 | Comp. Ex. 12 | Comp. Ex. 13 | Comp. Ex. 14 |
|---|---|---|---|---|---|---|---|
| Dispersant A, wt. % | — | — | — | — | — | — | 2.0 |
| Dispersant B, wt. % | — | — | — | — | 2.7 | — | — |
| Dispersant C, wt. % | — | — | — | — | — | 2.6 | — |
| Dispersant D, wt. % | — | 2.5 | 3.5 | 5.0 | — | — | — |
| Esso 600N, wt. % | 45 | 58 | 54 | 55 | 48 | 47 | 49 |
| Esso 150N, wt. % | — | 49 | — | — | — | — | — |
| Esso Core 2500 BS, wt. % | 42 | 35 | 29 | 26 | 36 | 38 | 36 |
| Base Number mg · KOH/g | 20 | 20 | 20 | 20 | 20 | 20 | 20 |
| Modified IP-48 vis increase, % | 72.1 | 69.1 | 69.3 | 56.2 | 68 | 80.3 | 72.7 |
| Foam tendency, ml | 150 | 170 | 140 | 150 | 180 | 130 | 190 |

As the results set forth in Table 3 show, the marine diesel cylinder lubricating oil compositions of Examples 13-14 exhibited equivalent and surprisingly better stability against oxidation-based viscosity increase, as is evident by the lower % vis increase as measured by the MIP-48 test, and the foaming tendency of the marine diesel cylinder lubricating oil composition of Examples 13-14 was directionally better over the comparatives. In particular, Example 13 resulted in improved foam performance at lower molar equivalent dispersant than the comparative examples. In addition, the marine diesel cylinder lubricating oil composition of Examples 13-14 each achieved the desired viscosities using less brightstock than the marine diesel cylinder lubricating oil compositions of the comparative examples.

Examples 15-16 and Comparative Examples 15-19

The marine cylinder lubricating oil compositions of Examples 15-16 and Comparative Examples 15-19 were prepared as set forth below in Table 4. Each marine cylinder lubricating oil composition was formulated to a SAE 50 viscosity grade oil using a majority amount of Group II basestock. Each of the marine cylinder lubricating oil compositions included in similar amounts the following additives: an oil concentrate of a 410 BN high overbased alkyl aromatic calcium sulfonate detergent, an oil concentrate of a 19 BN non-overbased alkyl aromatic calcium sulfonate detergent, a secondary zinc dialkyldithiophosphates, aminic anti-oxidant and foam inhibitor. Comparative Example 15 did not contain any succinimide dispersant and is the reference oil. The amount of dispersant in Comparative Examples 17, 18 and 19 are equivalent to 5.0 wt. % Dispersant D at an equal molar basis.

TABLE 4

SAE 50 Marine Cylinder Lubricating Oil Compositions

| | Comp. Ex. 15 | Comp. Ex. 16 | Ex. 15 | Ex. 16 | Comp. Ex. 17 | Comp. Ex. 18 | Comp. Ex. 19 |
|---|---|---|---|---|---|---|---|
| Dispersant A, wt. % | — | — | — | — | — | — | 2.0 |
| Dispersant B, wt. % | — | — | — | — | 2.7 | — | — |
| Dispersant C, wt. % | — | — | — | — | — | 2.6 | — |

TABLE 4-continued

| SAE 50 Marine Cylinder Lubricating Oil Compositions | Comp. Ex. 15 | Comp. Ex. 16 | Ex. 15 | Ex. 16 | Comp. Ex. 17 | Comp. Ex. 18 | Comp. Ex. 19 |
|---|---|---|---|---|---|---|---|
| Dispersant D, wt. % | — | 2.5 | 3.5 | 5.0 | — | — | — |
| Chevron 600N, wt. % | 45 | 45 | 48 | 55 | 48 | 47 | 49 |
| Esso Core 2500 BS, wt. % | 42 | 39 | 35 | 26 | 36 | 38 | 36 |
| Base Number, mgKOH/g | 20 | 20 | 20 | 20 | 20 | 20 | 20 |
| Modified IP-48 vis increase, % | 33.8 | 28.1 | 23.9 | 18.7 | 26.4 | 31.9 | 27.8 |
| Foam tendency, ml | 130 | 170 | 90 | 120 | 110 | 140 | 160 |

As the results set forth in Table 4 show, the marine diesel cylinder lubricating oil composition of Examples 15 and 16 exhibited equivalent and surprisingly better stability against oxidation-based viscosity increase, as is evident by the lower % vis increase as measured by the MIP-48 test, over the marine diesel cylinder lubricating oil compositions of Group II based cylinder lubricants of Comparative Examples 15-19, and the foaming tendency of the marine diesel cylinder lubricating oil composition of Examples 15-16 were either significantly improved or comparable to the comparative examples. In particular, Example 15 resulted in improved foam performance at lower molar equivalent dispersant than the comparative examples. In addition, the marine diesel cylinder lubricating oil compositions of Examples 15-16 achieved the desired viscosities using lower amounts of brightstock than the comparative.

Example 17 and Comparative Examples 20-23

The marine cylinder lubricating oil compositions of Example 17 and Comparative Examples 20-23 were prepared as set forth below in Table 5. Each marine cylinder lubricating oil composition was formulated to a SAE 50 viscosity grade oil using a majority amount of Group II basestock. Each of the marine cylinder lubricating oil compositions further included in similar amounts the following additives: an oil concentrate of a 114 BN sulfurized calcium alkyl phenate detergent, an oil concentrate of a 410 BN high overbased alkyl aromatic calcium sulfonate detergent, an oil concentrate of a 19 BN non-overbased alkyl aromatic calcium sulfonate detergent, aminic anti-oxidant and foam inhibitor. Comparative Example 20 did not contain any succinimide dispersant and is the reference oil. The amount of dispersant in Comparative Examples 21, 22 and 23 are equivalent to 5.0 wt. % Dispersant D at an equal molar basis.

TABLE 5

| SAE 50 Marine Cylinder Lubricating Oil Compositions | Comp. Ex. 20 | Ex. 17 | Comp. Ex. 21 | Comp. Ex. 22 | Comp. Ex. 23 |
|---|---|---|---|---|---|
| Dispersant A, wt. % | — | — | — | — | 2.05 |
| Dispersant B, wt. % | — | — | 2.69 | — | |
| Dispersant C, wt. % | — | — | — | 2.55 | |
| Dispersant D, wt. % | — | 5.0 | — | — | |
| Esso 600N, wt. % | — | — | — | — | — |
| Chevron 600N, wt. % | 45 | 61 | 48 | 48 | 50 |
| Esso Core 2500 BS, wt. % | 48 | 27 | 43 | 44 | 42 |
| Base Number, mg · KOH/g | 5.5 | 5.3 | 5.3 | 5.4 | 5.3 |

TABLE 5-continued

| SAE 50 Marine Cylinder Lubricating Oil Compositions | Comp. Ex. 20 | Ex. 17 | Comp. Ex. 21 | Comp. Ex. 22 | Comp. Ex. 23 |
|---|---|---|---|---|---|
| Modified IP-48 vis increase, % | 28.2 | 8.9 | 20.0 | 36.0 | 21.4 |
| Foam tendency, ml | 250 | 140 | 200 | 200 | 180 |

As the results set forth in Table 5 show, the marine diesel cylinder lubricating oil composition of Example 17 exhibited surprisingly better stability against oxidation-based viscosity increase, as is evident by the lower % vis increase as measured by the MIP-48 test, over the marine diesel cylinder lubricating oil compositions of Group II based cylinder lubricants of Comparative Examples 20-23, and the foaming tendency of the marine diesel cylinder lubricating oil composition of Example 17 was significantly better over the comparatives. In addition, the marine diesel cylinder lubricating oil compositions of Example 17 achieved the desired viscosity using less brightstock than the marine diesel cylinder lubricating oil compositions of the comparative examples.

Examples 18-19 and Comparative Examples 24-27

The marine cylinder lubricating oil compositions of Examples 18 and 19 and Comparative Examples 24-27 were prepared as set forth below in Table 6. Each marine cylinder lubricating oil composition was formulated to a SAE 60 viscosity grade oil using a majority amount of Group I basestock. Each of the marine cylinder lubricating oil compositions further included in similar amounts the following additives: an oil concentrate of a 114 BN sulfurized calcium alkyl phenate detergent, an oil concentrate of a 410 BN high overbased alkyl aromatic calcium sulfonate detergent, an oil concentrate of a 260 BN sulfurized calcium alkyl phenate detergent, a secondary zinc dialkyldithiophosphates and foam inhibitor. Comparative Example 24 did not contain any succinimide dispersant and is the reference oil. The amount of dispersant in Comparative Examples 25, 26 and 27 are equivalent to 5.0 wt. % Dispersant D at an equal molar basis.

TABLE 6

SAE 60 Marine Cylinder Lubricating Oil Compositions

| | Comp. Ex. 24 | Ex. 18 | Ex. 19 | Comp. Ex. 25 | Comp. Ex. 26 | Comp. Ex. 27 |
|---|---|---|---|---|---|---|
| Dispersant A, wt. % | — | — | — | — | — | 2.0 |
| Dispersant B, wt. % | — | — | — | 2.7 | — | — |
| Dispersant C, wt. % | — | — | — | — | 2.6 | — |
| Dispersant D, wt. % | — | 2.5 | 5.0 | — | — | — |
| Esso 600N, wt. % | 32 | 43 | 38 | 44 | 39 | 36 |
| Esso 150N, wt. % | — | 7 | 10 | — | — | — |
| Esso Core 2500 BS, wt. % | 20 | — | — | 6 | 11 | 15 |
| Base Number, mg · KOH/g | 150 | 150 | 150 | 150 | 150 | 150 |
| Modified IP-48 vis increase, % | 26.3 | −12.7 | −1.3 | 14.4 | 17.6 | 16.5 |
| Foam tendency, ml | 20 | 20 | 10 | 20 | 20 | 20 |

As the results set forth in Table 6 show, the marine diesel cylinder lubricating oil composition of Examples 18 and 19 exhibited surprisingly better stability against oxidation-based viscosity increase, as is evident by the lower % vis increase as measured by the MIP-48 test, over the marine diesel cylinder lubricating oil compositions of Group I based cylinder lubricants of Comparative Examples 24-27, and the foaming tendency of the marine diesel cylinder lubricating oil composition of Examples 18 and 19 were equivalent or significantly better over the comparatives. In addition, the marine diesel cylinder lubricating oil compositions of Examples 18 and 19 achieved the desired viscosity using less brightstock than the marine diesel cylinder lubricating oil compositions of the comparative examples.

It will be understood that various modifications may be made to the embodiments disclosed herein. Therefore the above description should not be construed as limiting, but merely as exemplifications of preferred embodiments. For example, the functions described above and implemented as the best mode for operating the present invention are for illustration purposes only. Other arrangements and methods may be implemented by those skilled in the art without departing from the scope and spirit of this invention. Moreover, those skilled in the art will envision other modifications within the scope and spirit of the claims appended hereto.

The following is an item list of exemplary embodiments of the present disclosure but no limitation to the full scope of the present concept:

1. A marine diesel cylinder lubricating oil composition which comprises (a) a major amount of an oil of lubricating viscosity, and (b) one or more non-borated polyalkenyl bis-succinimide dispersants, wherein the polyalkenyl substituent is derived from a polyalkene group having a number average molecular weight of from about 1500 to about 3000; and further wherein the marine diesel cylinder lubricating oil composition has a total base number (TBN) of about 5 to about 150.

2. The marine diesel cylinder lubricating oil composition of Item 1, having a TBN of from about 5 to about 100.

3. The marine diesel cylinder lubricating oil composition of Item 1, wherein the oil of lubricating viscosity comprises a Group I base stock.

4. The marine diesel cylinder lubricating oil composition of Item 1, wherein the oil of lubricating viscosity comprises a Group II base stock.

5. The marine diesel cylinder lubricating oil composition of Item 1, wherein the one or more non-borated polyalkenyl bis-succinimide dispersants are one or more non-borated polyalkenyl bis-succinimide dispersants, wherein the polyalkenyl substituent is derived from a polyalkene group having a number average molecular weight of from about 1500 to about 2500.

6. The marine diesel cylinder lubricating oil composition of Item 1, wherein the one or more non-borated polyalkenyl bis-succinimide dispersants are one or more non-borated polyalkenyl bis-succinimide dispersants, wherein the polyalkenyl substituent is derived from a polybutene group having a number average molecular weight of from about 1500 to about 3000.

7. The marine diesel cylinder lubricating oil composition of Item 1, wherein the one or more non-borated polyalkenyl bis-succinimide dispersants are one or more non-borated polyalkenyl bis-succinimide dispersants, wherein the polyalkenyl substituent is derived from a polybutene group having a number average molecular weight of from about 1500 to about 2500.

8. The marine diesel cylinder lubricating oil composition of Item 1, wherein the one or more non-borated polyalkenyl bis-succinimide dispersants are present in an amount of from about 0.25 to about 10 wt. %, on an actives basis, based on the total weight of the marine diesel cylinder lubricating oil composition.

9. The marine diesel cylinder lubricating oil composition of Item 1, wherein the one or more non-borated polyalkenyl bis-succinimide dispersants are present in an amount of from about 1 to about 5 wt. %, on an actives basis, based on the total weight of the marine diesel cylinder lubricating oil composition.

10. The marine diesel cylinder lubricating oil composition of Item 1, further comprising one or more marine diesel cylinder lubricating oil composition additives selected from the group consisting of an antioxidant, detergent, rust inhibitor, dehazing agent, demulsifying agent, metal deactivating agent, friction modifier, pour point depressant, antifoaming agent, co-solvent, corrosion-inhibitor, dyes, extreme pressure agent and mixtures thereof.

11. A method for lubricating a marine two-stroke crosshead diesel engine with a marine diesel cylinder lubricant composition having improved oxidation stability; wherein the method comprises operating the engine with a marine diesel cylinder lubricating oil composition comprising (a) a major amount of an oil of lubricating viscosity, and (b) one or more non-borated polyalkenyl bis-succinimide dispersants, wherein the polyalkenyl substituent is derived from a polyalkene group having a number average molecular weight of from about 1500 to about 3000; and further wherein the marine diesel cylinder lubricating oil composition has a total base number (TBN) of about 5 to about 150.

12. The method of Item 11, wherein the marine diesel cylinder lubricating oil composition has a TBN of from about 5 to about 100.

13. The method of Item 11, wherein the oil of lubricating viscosity comprises a Group I base stock or a Group II base stock.

14. The method of Item 11, wherein the one or more non-borated polyalkenyl bis-succinimide dispersants are one or more non-borated polyalkenyl bis-succinimide dispersants, wherein the polyalkenyl substituent is derived from a polyalkene group having a number average molecular weight of from about 1500 to about 2500.

15. The method of Item 11, wherein the one or more non-borated polyalkenyl bis-succinimide dispersants are one or more non-borated polyalkenyl bis-succinimide dispersants, wherein the polyalkenyl substituent is derived from a polybutene group having a number average molecular weight of from about 1500 to about 3000.

16. The method of Item 11, wherein the one or more non-borated polyalkenyl bis-succinimide dispersants are one or more non-borated polyalkenyl bis-succinimide dispersants, wherein the polyalkenyl substituent is derived from a polybutene group having a number average molecular weight of from about 1500 to about 2500.

17. The method of Item 11, wherein the one or more non-borated polyalkenyl bis-succinimide dispersants are present in an amount of from about 0.25 to about 10 wt. %, on an actives basis, based on the total weight of the marine diesel cylinder lubricating oil composition.

18. The method of Item 11, wherein the one or more non-borated polyalkenyl bis-succinimide dispersants are present in an amount of from about 1 to about 5 wt. %, on an actives basis, based on the total weight of the marine diesel cylinder lubricating oil composition.

19. The method of Item 11, wherein the marine diesel cylinder lubricating oil composition further comprises one or more marine diesel cylinder lubricating oil composition additives selected from the group consisting of an antioxidant, detergent, rust inhibitor, dehazing agent, demulsifying agent, metal deactivating agent, friction modifier, pour point depressant, antifoaming agent, co-solvent, corrosion-inhibitor, dyes, extreme pressure agent and mixtures thereof.

20. A marine diesel cylinder lubricating oil composition which comprises (a) a major amount of an oil of lubricating viscosity, and (b) one or more cyclic carbonate post-treated polyalkenyl bis-succinimide dispersants, wherein the marine diesel cylinder lubricating oil composition has a total base number (TBN) of about 5 to about 150.

21. The marine diesel cylinder lubricating oil composition of Item 20, having a TBN of from about 5 to about 100.

22. The marine diesel cylinder lubricating oil composition of Item 20, wherein the oil of lubricating viscosity comprises a Group I base stock.

23. The marine diesel cylinder lubricating oil composition of Item 20, wherein the oil of lubricating viscosity comprises a Group II base stock.

24. The marine diesel cylinder lubricating oil composition of Item 20, wherein the one or more cyclic carbonate post-treated polyalkenyl bis-succinimide dispersants are one or more cyclic carbonate post-treated polyalkenyl bis-succinimide dispersants, wherein the polyalkenyl substituent is derived from a polyalkene group having a number average molecular weight of from about 500 to about 5000.

25. The marine diesel cylinder lubricating oil composition of Item 20, wherein the one or more cyclic carbonate post-treated polyalkenyl bis-succinimide dispersants are one or more cyclic carbonate post-treated polyalkenyl bis-succinimide dispersants, wherein the polyalkenyl substituent is derived from a polyalkene group having a number average molecular weight of from about 700 to about 3000.

26. The marine diesel cylinder lubricating oil composition of Item 20, wherein the one or more cyclic carbonate post-treated polyalkenyl bis-succinimide dispersants are one or more ethylene carbonate post-treated polyalkenyl bis-succinimide dispersants, wherein the polyalkenyl substituent is derived from a polybutene group having a number average molecular weight of from about 500 to about 5000.

27. The marine diesel cylinder lubricating oil composition of Item 20, wherein the one or more cyclic carbonate post-treated polyalkenyl bis-succinimide dispersants are one or more ethylene carbonate post-treated polyalkenyl bis-succinimide dispersants, wherein the polyalkenyl substituent is derived from a polybutene group having a number average molecular weight of from about 700 to about 3000.

28. The marine diesel cylinder lubricating oil composition of Item 20, wherein the one or more cyclic carbonate post-treated polyalkenyl bis-succinimide dispersants are present in an amount of from about 0.25 to about 10 wt. %, on an actives basis, based on the total weight of the marine diesel cylinder lubricating oil composition.

29. The marine diesel cylinder lubricating oil composition of Item 20, wherein the one or more cyclic carbonate post-treated polyalkenyl bis-succinimide dispersants are present in an amount of from about 1 to about 5 wt. %, on an actives basis, based on the total weight of the marine diesel cylinder lubricating oil composition.

30. The marine diesel cylinder lubricating oil composition of Item 20, further comprising one or more marine diesel cylinder lubricating oil composition additives selected from the group consisting of an antioxidant, detergent, rust inhibitor, dehazing agent, demulsifying agent, metal deactivating agent, friction modifier, pour point depressant, antifoaming agent, co-solvent, corrosion-inhibitor, dyes, extreme pressure agent and mixtures thereof.

31. A method for lubricating a marine two-stroke crosshead diesel engine with a marine diesel cylinder lubricant composition having improved oxidation stability; wherein the method comprises operating the engine with a marine diesel cylinder lubricating oil composition comprising (a) a major amount of an oil of lubricating viscosity, and (b) one or more cyclic carbonate post-treated polyalkenyl bis-succinimide dispersants, wherein the marine diesel cylinder lubricating oil composition has a total base number (TBN) of about 5 to about 150.

32. The method of Item 31, wherein the marine diesel cylinder lubricating oil composition has a TBN of from about 5 to about 100.

33. The method of Item 31, wherein the oil of lubricating viscosity comprises a Group I base stock or a Group II base stock.

34. The method of Item 31, wherein the one or more cyclic carbonate post-treated polyalkenyl bis-succinimide dispersants are one or more cyclic carbonate post-treated polyalkenyl bis-succinimide dispersants, wherein the polyalkenyl substituent is derived from a polyalkene group having a number average molecular weight of from about 500 to about 5000.

35. The method of Item 31, wherein the one or more cyclic carbonate post-treated polyalkenyl bis-succinimide dispersants are one or more cyclic carbonate post-treated polyalkenyl bis-succinimide dispersants, wherein the polyalkenyl substituent is derived from a polyalkene group having a number average molecular weight of from about 700 to about 3000.

36. The method of Item 31, wherein the one or more cyclic carbonate post-treated polyalkenyl bis-succinimide dispersants are one or more ethylene carbonate post-treated polyalkenyl bis-succinimide dispersants, wherein the polyalkenyl substituent is derived from a polybutene group having a number average molecular weight of from about 500 to about 5000.

37. The method of Item 31, wherein the one or more cyclic carbonate post-treated polyalkenyl bis-succinimide dispersants are one or more ethylene carbonate post-treated polyalkenyl bis-succinimide dispersants, wherein the polyalkenyl substituent is derived from a polybutene group having a number average molecular weight of from about 700 to about 3000.

38. The method of Item 31, wherein the one or more cyclic carbonate post-treated polyalkenyl bis-succinimide dispersants are present in an amount of from about 0.25 to about 10 wt. %, on an actives basis, based on the total weight of the marine diesel cylinder lubricating oil composition.

39. The method of Item 31, wherein the one or more cyclic carbonate post-treated polyalkenyl bis-succinimide dispersants are present in an amount of from about 1 to about 5 wt. %, on an actives basis, based on the total weight of the marine diesel cylinder lubricating oil composition.

40. The method of Item 31, wherein the marine diesel cylinder lubricating oil composition further comprises one or more marine diesel cylinder lubricating oil composition additives selected from the group consisting of an antioxidant, detergent, rust inhibitor, dehazing agent, demulsifying agent, metal deactivating agent, friction modifier, pour point depressant, antifoaming agent, co-solvent, corrosion-inhibitor, dyes, extreme pressure agent and mixtures thereof.

41. A marine diesel cylinder lubricating oil composition which comprises (a) a major amount of a Group I base stock oil of lubricating viscosity, and (b) a non-borated polyalkenyl bis-succinimide dispersant present in an amount of from about 1.5 to about 8.0 wt. %, on an actives basis, based on the total weight of the marine diesel cylinder lubricating oil composition, wherein the polyalkenyl substituent is derived from a polyalkene group having a number average molecular weight of from about 1500 to about 3000; and further wherein the marine diesel cylinder lubricating oil composition has a total base number (TBN) of about 5 to about 30.

42. The marine diesel cylinder lubricating oil composition of Item 41, wherein the number average molecular weight is from about 1500 to about 2500.

43. The marine diesel cylinder lubricating oil composition of Item 41, wherein the polyalkylene group is a polybutene group.

44. The marine diesel cylinder lubricating oil composition of Item 41, further comprising one or more marine diesel cylinder lubricating oil composition additives selected from the group consisting of an antioxidant, a detergent, a rust inhibitor, a dehazing agent, a demulsifying agent, a metal deactivating agent, a friction modifier, a pour point depressant, an antifoaming agent, a co-solvent, a corrosion-inhibitor, a dye, an extreme pressure agent, a thickening agent, and mixtures thereof.

45. The marine diesel cylinder lubricating oil composition of Item 41, wherein the non-borated polyalkenyl bis-succinimide dispersant is a cyclic carbonate post-treated polyalkenyl bis-succinimide dispersant.

46. A marine diesel cylinder lubricating oil composition which comprises (a) a major amount of a Group I base stock oil of lubricating viscosity, and (b) a non-borated polyalkenyl bis-succinimide dispersants present in an amount of from about 1.0 to about 5.0 wt. %, on an actives basis, based on the total weight of the marine diesel cylinder lubricating oil composition, wherein the polyalkenyl substituent is derived from a polyalkene group having a number average molecular weight of from about 1500 to about 3000; and further wherein the marine diesel cylinder lubricating oil composition has a total base number (TBN) of greater than about 30.

47. The marine diesel cylinder lubricating oil composition of Item 46, wherein the number average molecular weight is from about 1500 to about 2500.

48. The marine diesel cylinder lubricating oil composition of Item 46, wherein the polyalkylene group is a polybutene group.

49. The marine diesel cylinder lubricating oil composition of Item 46, further comprising one or more marine diesel cylinder lubricating oil composition additives selected from the group consisting of an antioxidant, a detergent, a rust inhibitor, a dehazing agent, a demulsifying agent, a metal deactivating agent, a friction modifier, a pour point depressant, an antifoaming agent, a co-solvent, a corrosion-inhibitor, a dye, an extreme pressure agent, a thickening agent, and mixtures thereof.

50. The marine diesel cylinder lubricating oil composition of Item 46, wherein the non-borated polyalkenyl bis-succinimide dispersant is a cyclic carbonate post-treated polyalkenyl bis-succinimide dispersant.

51. A marine diesel cylinder lubricating oil composition which comprises (a) a major amount of a Group II base stock oil of lubricating viscosity, and (b) a non-borated polyalkenyl bis-succinimide dispersants present in an amount of from about 1.5 to about 8.0 wt. %, on an actives basis, based on the total weight of the marine diesel cylinder lubricating oil composition, wherein the polyalkenyl substituent is derived from a polyalkene group having a number average molecular weight of from about 1500 to about 3000; and further wherein the marine diesel cylinder lubricating oil composition has a total base number (TBN) of about 5 to about 20.

52. The marine diesel cylinder lubricating oil composition of Item 51, wherein the number average molecular weight is from about 1500 to about 2500.

53. The marine diesel cylinder lubricating oil composition of Item 51, wherein the polyalkylene group is a polybutene group.

54. The marine diesel cylinder lubricating oil composition of Item 51, further comprising one or more marine diesel cylinder lubricating oil composition additives selected from the group consisting of an antioxidant, a detergent, a rust inhibitor, a dehazing agent, a demulsifying agent, a metal deactivating agent, a friction modifier, a pour point depressant, an antifoaming agent, a co-solvent, a corrosion-inhibitor, a dye, an extreme pressure agent, a thickening agent, and mixtures thereof.

55. The marine diesel cylinder lubricating oil composition of Item 51, wherein the non-borated polyalkenyl bis-succinimide dispersant is a cyclic carbonate post-treated polyalkenyl bis-succinimide dispersant.

56. A marine diesel cylinder lubricating oil composition which comprises (a) a major amount of a Group II base stock oil of lubricating viscosity, and (b) a non-borated polyalkenyl bis-succinimide dispersants present in an amount of from about 1.0 to about 5.0 wt. %, on an actives basis, based on the total weight of the marine diesel cylinder lubricating oil composition, wherein the polyalkenyl substituent is derived from a polyalkene group having a number average molecular weight of from about 1500 to about 3000; and further wherein the marine diesel cylinder lubricating oil composition has a total base number (TBN) of greater than about 20.

57. The marine diesel cylinder lubricating oil composition of Item 56, wherein the number average molecular weight is from about 1500 to about 2500.

58. The marine diesel cylinder lubricating oil composition of Item 56, wherein the polyalkylene group is a polybutene group.

59. The marine diesel cylinder lubricating oil composition of Item 56, further comprising one or more marine diesel cylinder lubricating oil composition additives selected from the group consisting of an antioxidant, a detergent, a rust inhibitor, a dehazing agent, a demulsifying agent, a metal deactivating agent, a friction modifier, a pour point depressant, an antifoaming agent, a co-solvent, a corrosion-inhibitor, a dye, an extreme pressure agent, a thickening agent, and mixtures thereof.

60. The marine diesel cylinder lubricating oil composition of Item 56, wherein the polyalkenyl bis-succinimide dispersant is a cyclic carbonate post-treated polyalkenyl bis-succinimide dispersants.

61. Use of a marine diesel cylinder lubricating oil composition in any one of Items 41 through 60 in a two-stroke crosshead diesel engine.

62. Use of at least 1.0 wt. %, on an actives basis, of a cyclic carbonate post-treated polyalkenyl bis-succinimide dispersant as an oil thickener for a marine diesel cylinder lubricating composition.

What is claimed is:

1. A marine diesel cylinder lubricating oil composition which comprises (a) a major amount of a Group I base stock oil of lubricating viscosity, and (b) a non-borated, post-treated polybutene bis-succinimide dispersant present in an amount of from about 1.5 to about 8.0 wt. %, on an actives basis, based on the total weight of the marine diesel cylinder lubricating oil composition, wherein the polybutene substituent is derived from a polybutene group having a number average molecular weight of from about 1500 to about 2500; and further wherein the marine diesel cylinder lubricating oil composition has a total base number (TBN) of about 20 to about 30.

2. The marine diesel cylinder lubricating oil composition of claim 1, wherein the number average molecular weight is from about 2000 to about 2500.

3. The marine diesel cylinder lubricating oil composition of claim 1, further comprising one or more marine diesel cylinder lubricating oil composition additives selected from the group consisting of an antioxidant, a detergent, a rust inhibitor, a dehazing agent, a demulsifying agent, a metal deactivating agent, a friction modifier, a pour point depressant, an antifoaming agent, a co-solvent, a corrosion-inhibitor, a dye, an extreme pressure agent, and mixtures thereof.

4. The marine diesel cylinder lubricating oil composition of claim 1, wherein the non-borated, post-treated polybutene bis-succinimide dispersant is a cyclic carbonate post-treated polybutene bis-succinimide dispersant.

5. A marine diesel cylinder lubricating oil composition which comprises (a) a major amount of a Group I base stock oil of lubricating viscosity, and (b) a non-borated, post-treated polybutene bis-succinimide dispersants present in an amount of greater than 1.0 to about 5.0 wt. %, on an actives basis, based on the total weight of the marine diesel cylinder lubricating oil composition, wherein the polybutene substituent is derived from a polybutene group having a number average molecular weight of from about 1500 to about 2500; and further wherein the marine diesel cylinder lubricating oil composition has a total base number (TBN) of greater than about 30 and less than about 150.

6. The marine diesel cylinder lubricating oil composition of claim 5, wherein the number average molecular weight is from about 2000 to about 2500.

7. The marine diesel cylinder lubricating oil composition of claim 5, further comprising one or more marine diesel cylinder lubricating oil composition additives selected from the group consisting of an antioxidant, a detergent, a rust inhibitor, a dehazing agent, a demulsifying agent, a metal deactivating agent, a friction modifier, a pour point depressant, an antifoaming agent, a co-solvent, a corrosion-inhibitor, a dye, an extreme pressure agent, and mixtures thereof.

8. The marine diesel cylinder lubricating oil composition of claim 5, wherein the non-borated, post-treated polybutene bis-succinimide dispersant is a cyclic carbonate post-treated polybutene bis-succinimide dispersant.

9. A marine diesel cylinder lubricating oil composition which comprises (a) a major amount of a Group II base stock oil of lubricating viscosity, and (b) a non-borated, post-treated polybutene bis-succinimide dispersants present in an amount of from about 1.5 to about 8.0 wt. %, on an actives basis, based on the total weight of the marine diesel cylinder lubricating oil composition, wherein the polybutene substituent is derived from a polybutene group having a number average molecular weight of from about 1500 to about 2500; and further wherein the marine diesel cylinder lubricating oil composition has a total base number (TBN) of about 5 to about 20.

10. The marine diesel cylinder lubricating oil composition of claim 9, wherein the number average molecular weight is from about 2000 to about 2500.

11. The marine diesel cylinder lubricating oil composition of claim 9, further comprising one or more marine diesel cylinder lubricating oil composition additives selected from the group consisting of an antioxidant, a detergent, a rust inhibitor, a dehazing agent, a demulsifying agent, a metal deactivating agent, a friction modifier, a pour point depressant, an antifoaming agent, a co-solvent, a corrosion-inhibitor, a dye, an extreme pressure agent, and mixtures thereof.

12. The marine diesel cylinder lubricating oil composition of claim 9, wherein the non-borated, post-treated polybutene bis-succinimide dispersant is a cyclic carbonate post-treated polybutene bis-succinimide dispersant.

13. A marine diesel cylinder lubricating oil composition which comprises (a) a major amount of a Group II base stock oil of lubricating viscosity, and (b) a non-borated, post-treated polybutene bis-succinimide dispersants present in an amount of greater than 1.0 to about 5.0 wt. %, on an actives basis, based on the total weight of the marine diesel cylinder lubricating oil composition, wherein the polybutene substituent is derived from a polybutene group having a number average molecular weight of from about 1500 to about 2500; and further wherein the marine diesel cylinder lubricating oil composition has a total base number (TBN) of greater than about 20 and less than about 100.

14. The marine diesel cylinder lubricating oil composition of claim 13, wherein the number average molecular weight is from about 2000 to about 2500.

15. The marine diesel cylinder lubricating oil composition of claim 13, further comprising one or more marine diesel cylinder lubricating oil composition additives selected from the group consisting of an antioxidant, a detergent, a rust inhibitor, a dehazing agent, a demulsifying agent, a metal deactivating agent, a friction modifier, a pour point depressant, an antifoaming agent, a co-solvent, a corrosion-inhibitor, a dye, an extreme pressure agent, and mixtures thereof.

16. The marine diesel cylinder lubricating oil composition of claim 13, wherein the non-borated, post-treated polybutene bis-succinimide dispersant is a cyclic carbonate post-treated polybutene bis-succinimide dispersants.

17. The marine diesel cylinder lubricating oil composition of claim 1, wherein the non-borated, post-treated polybutene bis-succinimide dispersant is present in an amount of from about 2.5 to about 5.0 wt. %, on an actives basis, based on the total weight of the marine diesel cylinder lubricating oil composition.

18. The marine diesel cylinder lubricating oil composition of claim 5, wherein the non-borated, post-treated polybutene bis-succinimide dispersant is present in an amount of from about 2.0 to about 5.0 wt. %, on an actives basis, based on the total weight of the marine diesel cylinder lubricating oil composition.

19. The marine diesel cylinder lubricating oil composition of claim 9, wherein the non-borated, post-treated polybutene bis-succinimide dispersant is present in an amount of from about 2.0 to about 5.0 wt. %, on an actives basis, based on the total weight of the marine diesel cylinder lubricating oil composition.

20. The marine diesel cylinder lubricating oil composition of claim 13, wherein the non-borated, post-treated polybutene bis-succinimide dispersant is present in an amount of from about 2.0 to about 5.0 wt. %, on an actives basis, based on the total weight of the marine diesel cylinder lubricating oil composition.

* * * * *